US008390660B2

(12) United States Patent
Ogasahara

(10) Patent No.: US 8,390,660 B2
(45) Date of Patent: Mar. 5, 2013

(54) IMAGE FORMING APPARATUS

(75) Inventor: Okito Ogasahara, Osaka (JP)

(73) Assignee: Kyocera Mita Corporation (JP)

( * ) Notice: Subject to any disclaimer, the term of this patent is extended or adjusted under 35 U.S.C. 154(b) by 368 days.

(21) Appl. No.: 12/717,307

(22) Filed: Mar. 4, 2010

(65) Prior Publication Data

US 2010/0226672 A1 Sep. 9, 2010

(30) Foreign Application Priority Data

Mar. 5, 2009 (JP) ..... 2009-051890

(51) Int. Cl.
*B41J 2/435* (2006.01)

(52) U.S. Cl. ..... 347/224; 347/229; 347/234

(58) Field of Classification Search ..... 347/224, 347/229, 234; 399/51
See application file for complete search history.

(56) References Cited

U.S. PATENT DOCUMENTS

| | | | | |
|---|---|---|---|---|
| 5,317,419 | A * | 5/1994 | Koizumi | 358/462 |
| 5,909,300 | A * | 6/1999 | Araki et al. | 359/201.1 |
| 6,346,958 | B2 * | 2/2002 | Kanno | 347/116 |
| 7,551,337 | B2 * | 6/2009 | Hirakawa et al. | 359/204.1 |
| 2002/0063770 | A1 | 5/2002 | Takesue | |
| 2004/0075877 | A1 | 4/2004 | Takesue | |
| 2005/0093969 | A1 * | 5/2005 | Takesue | 347/240 |
| 2005/0117014 | A1 * | 6/2005 | Livne | 347/238 |

FOREIGN PATENT DOCUMENTS

| | | |
|---|---|---|
| JP | 2002-137447 | 5/2002 |
| JP | 2005053000 | 3/2005 |

* cited by examiner

*Primary Examiner* — Stephen Meier
*Assistant Examiner* — Sarah Al Hashimi
(74) *Attorney, Agent, or Firm* — Gerald E. Hespos; Michael J. Porco; Matthew T. Hespos

(57) ABSTRACT

An image forming apparatus has a first light controller to shift starts of image writing operations of light sources by a first time interval. A test data storage stores, beforehand, test image data having dot columns formed by one-dot images arranged in a row in a sub-scanning direction and at predetermined intervals in a main scanning direction. An operation controller controls an image carrier at a speed so that adjacent dot images in the sub-scanning direction overlap. A second light controller forms electrostatic latent test images on the image carrier based on timing signals with the image carrier moved by the operation controller, and draws electrostatic latent test images with different time intervals. A density measurer measures densities of the developed test images. A time interval adjusting section adjusts the time interval based on the time interval used to draw the electrostatic latent test image having the lowest measured density.

14 Claims, 19 Drawing Sheets

EMISSION
EMISSION
EMISSION
EMISSION
T
T
T
LD1
0
T
2T
3T

EMISSION
EMISSION
EMISSION
EMISSION
T
T
T
LD2
Δt
Δt+T
Δt+2T
Δt+3T

EMISSION
EMISSION
EMISSION
EMISSION
T
T
T
LD3
2Δt
2Δt+T
2Δt+2T
2Δt+3T

EMISSION
EMISSION
EMISSION
EMISSION
T
T
T
LD4
3Δt
3Δt+T
3Δt+2T
3Δt+3T

EMISSION
EMISSION
EMISSION
EMISSION
T
T
T
LD5
4Δt
4Δt+T
4Δt+2T
4Δt+3T

EMISSION
EMISSION
EMISSION
EMISSION
T
T
T
LD6
5Δt
5Δt+T
5Δt+2T
5Δt+3T

FIG.10

| LASER LIGHT SOURCE | EMISSION PATTERN | | | | |
|---|---|---|---|---|---|
| | PATTERN 1 | PATTERN 2 | PATTERN 3 | PATTERN 4 | PATTERN 5 |
| LD1 | 0 | 0 | 0 | 0 | 0 |
| LD2 | $\Delta t$ | $\Delta t+\Delta\alpha$ | $\Delta t+2\Delta\alpha$ | $\Delta t-\Delta\alpha$ | $\Delta t-2\Delta\alpha$ |
| LD3 | $2\Delta t$ | $2(\Delta t+\Delta\alpha)$ | $2(\Delta t+2\Delta\alpha)$ | $2(\Delta t-\Delta\alpha)$ | $2(\Delta t-2\Delta\alpha)$ |
| LD4 | $3\Delta t$ | $3(\Delta t+\Delta\alpha)$ | $3(\Delta t+2\Delta\alpha)$ | $3(\Delta t-\Delta\alpha)$ | $3(\Delta t-2\Delta\alpha)$ |
| LD5 | $4\Delta t$ | $4(\Delta t+\Delta\alpha)$ | $4(\Delta t+2\Delta\alpha)$ | $4(\Delta t-\Delta\alpha)$ | $4(\Delta t-2\Delta\alpha)$ |
| LD6 | $5\Delta t$ | $5(\Delta t+\Delta\alpha)$ | $5(\Delta t+2\Delta\alpha)$ | $5(\Delta t-\Delta\alpha)$ | $5(\Delta t-2\Delta\alpha)$ |
| FIRST TIME INTERVAL : | $\Delta t$ | $\Delta t+\Delta\alpha$ | $\Delta t+2\Delta\alpha$ | $\Delta t-\Delta\alpha$ | $\Delta t-2\Delta\alpha$ |

IMAGE FORMING APPARATUS

CROSS REFERENCES TO RELATED APPLICATIONS

The present invention contains subject matter related to Japanese Patent Application No. 2009-051890 filed in the Japanese Patent Office on Mar. 5, 2009, the entire contents of which are incorporated herein by reference.

BACKGROUND OF THE INVENTION

1. Field of the Invention

The present invention relates to a multi-beam image forming apparatus.

2. Description of the Related Art

There has been conventionally widely known an electrophotographic image forming apparatus which includes a light source unit for outputting a light beam such as a laser beam and forms an electrostatic latent image on a surface of an image carrier such as a photoconductive drum by scanning the surface of the photoconductive drum with a light beam output from the light source unit while reflecting the light beam toward the surface of the photoconductive drum by reflecting surfaces of a rotary polygon mirror. In an image forming apparatus of this type, a multi-beam method has been proposed for the purpose of shortening a time required for image formation. The multi-beam method is a method for forming an electrostatic latent image by simultaneously irradiating a plurality of light beams in parallel to an image carrier such as a photoconductive member by a light source unit of a plurality of light sources respectively for outputting light beams.

In a multi-beam image forming apparatus, the phases of respective light beams may be shifted in a main scanning direction due to an error in mounting semiconductor lasers, maladjustment and the like. A technology combining the following four points has been proposed to overcome this problem. The first point is to form a first pattern group by repeatedly forming a first pattern in a main scanning direction and a sub scanning direction. The first pattern is formed by one and another image patterns. The one image pattern is the one formed by repeating an operation of forming a certain dot row extending in the main scanning direction on a photoconductive member by a light beam from one of four semiconductor lasers in the sub scanning direction by as many (four) cycles as light beams. The other image pattern is the one formed by repeating an operation of forming a certain dot row extending in the main scanning direction on the photoconductive member by a light beam from the next semiconductor laser in the sub scanning direction by as many (four) cycles as light beams. The second point is to form a second pattern group by repeatedly forming a second pattern in the main scanning direction and the sub scanning direction. The second pattern is a pattern obtained by mirroring the first pattern in the main scanning direction. The third point is to set a plurality of combinations each comprised of two semiconductor lasers, which output adjacent light beams, out of four semiconductor lasers and form the first and second pattern groups for each combination. The fourth point is to detect the presence or absence of a phase shift in the main scanning direction between one and the other light beams in each combination according to whether or not the print density of the first pattern group and that of the second pattern group differ in each combination.

However, with the above technology, in the case of increasing the number of light sources installed in the light source unit without considerably increasing the size of the light source unit, a distance between arrival positions of two beams in each combination becomes narrower as the number of the installed light sources increases. Thus, differences between the width and area of a region where toner is attached in the first pattern group and those of a region where toner is attached in the second pattern group become smaller. In other words, as the number of the installed light sources increases, a difference between the print density of the first pattern group and that of the second pattern group becomes smaller, wherefore accuracy in detecting the presence or absence of the phase shift may be possibly reduced. Hence, the above technology is thought to be improper for the detection of the presence or absence of a phase shift in a light source unit including many light sources.

SUMMARY OF THE INVENTION

An object of the present invention is to provide a multi-beam image forming apparatus which includes a plurality of light sources and can make such an adjustment as to align image write starting positions of light beams constituting a multi-beam in a main scanning direction.

In order to accomplish this object, one aspect of the present invention is directed to an image forming apparatus, having a light source unit including a plurality of light sources for irradiating a multi-beam composed of light beams emitted from the plurality of light sources; a light beam deflector for deflecting the multi-beam irradiated from the light source unit in a main scanning direction; an image carrier, on which an electrostatic latent image is to be drawn by the multi-beam deflected by the light beam deflector; and a timing signal generator for generating timing signals on a basis for the starts of image writing operations at the starts of the image writing operations by the plurality of light sources to start drawing an electrostatic latent image on the image carrier, the timing signal generator including a first optical sensor for receiving the light beams respectively emitted from the plurality of light sources to obtain timing signals after the light beams are deflected by the light beam deflector, the timing signal generator for generating the timing signals based on signals output from the first optical sensor; wherein: a positional relationship of the plurality of light sources with respect to the first optical sensor is so set that the timing signals corresponding to the light beams respectively emitted from the plurality of light sources can be separately generated at different timings by the timing signal generator; and the image forming apparatus further comprises: a first light emission controlling section used in a normal operation mode for executing a control to shift the starts of the image writing operations by the plurality of light sources by a first time interval to align image write starting positions of the respective light beams in the main scanning direction in the case of drawing an electrostatic latent image on the image carrier by the multi-beam irradiated from the light source unit on a basis the timing signals generated by the timing signal generator; a time interval data storage storing the first time interval used for the control in the first light emission controlling section beforehand; a test image data storage storing an image data of a test image beforehand, in which dot rows each formed by one-dot images arranged in a row in a sub scanning direction are arranged at predetermined intervals in the main scanning direction; an operation controlling section for controlling the operation of the image carrier at such a speed that the dot images adjacent in the sub scanning direction overlap; a second light emission controlling section used in a first time interval adjustment mode for drawing an electrostatic latent image of the test image on the image carrier by causing the light source unit to irradiate a multi-beam modulated by the test image data stored in the test image data storage on a basis the timing signals generated by the timing signal generator and causing the light beam deflector to deflect the multi-beam with the image carrier moved by the operation controlling section, and the second light emission controlling section for executing a control to draw electrostatic latent images of a plurality of test images with different first time intervals; a developing unit for developing the electrostatic latent images of the test images drawn on the image carrier by the second light emission controlling section; a density measuring section for measuring the densities of the plurality of test images developed by the developing unit; and a first time interval adjusting section for adjusting the first time interval used for the control in the first light emission controlling section and stored in the time interval data storage based on the first time interval used to draw the electrostatic latent image of the test image having the lowest density out of the plurality of test images measured by the density measuring section.

In order to accomplish the above object, another aspect of the present invention is directed to an image forming apparatus, having a light source unit including a plurality of light sources for irradiating a multi-beam composed of light beams emitted from the plurality of light sources; a light beam deflector for deflecting the multi-beam irradiated from the light source unit in a main scanning direction; an image carrier, on which an electrostatic latent image is to be drawn by the multi-beam deflected by the light beam deflector; and a timing signal generator for generating timing signals on a basis for the starts of image writing operations at the starts of the image writing operations by the plurality of light sources to start drawing an electrostatic latent image on the image carrier, the timing signal generator including a first optical sensor for receiving the light beams respectively emitted from the plurality of light sources to obtain timing signals after the light beams are deflected by the light beam deflector, the timing signal generator for generating the timing signals based on signals output from the first optical sensor; wherein: a positional relationship of the plurality of light sources with respect to the first optical sensor is so set that the timing signals corresponding to the light beams respectively emitted from the plurality of light sources can be separately generated at different timings by the timing signal generator; and the image forming apparatus further comprises: a first light emission controlling section used in a normal operation mode for executing a control to shift the starts of the image writing operations by the plurality of light sources by a first time interval to align image write starting positions of the respective light beams in the main scanning direction in the case of drawing an electrostatic latent image on the image carrier by the multi-beam irradiated from the light source unit on a basis the timing signals generated by the timing signal generator; a time interval data storage storing the first time interval used for the control in the first light emission controlling section beforehand; a test image data storage storing an image data of a test image beforehand, in which dot rows each drawn by one-dot images arranged in a row in a sub scanning direction are arranged at predetermined intervals in the main scanning direction; an operation controlling section for controlling the operation of the image carrier at such a speed that the dot images adjacent in the sub scanning direction overlap; a second light emission controlling section used in a first time interval adjustment mode for drawing an electrostatic latent image of a test image on the image carrier by causing the light source unit to irradiate a multi-beam modulated by the test image data stored in the test image data storage on a basis the timing signals generated by the timing signal generator and causing the light beam deflector to deflect the multi-beam with the image carrier moved by the operation controlling section, and the second light emission controlling section for executing a control to draw electrostatic latent images of a plurality of test images with different first time intervals; a developing unit for developing the electrostatic latent images of the test images drawn on the image carrier by the second light emission controlling section; an image output unit for outputting the plurality of test images developed by the developing unit by recording them on a recording sheet or recording sheets; an operation unit for receiving an operation of inputting specific information specifying the test image having the lowest density out of the plurality of test images output by the image output unit; and a first time interval adjusting section for adjusting the first time interval used for the control in the first light emission controlling section and stored in the time interval data storage to the first time interval used to draw the electrostatic latent image of the test image specified by the specific information input to the operation unit.

BRIEF DESCRIPTION OF THE DRAWINGS

FIG. 10 is a table showing a plurality of emission patterns executed by the light emission controlling section (second light emission controlling section) shown in FIG. 3.

DETAILED DESCRIPTION OF THE PREFERRED EMBODIMENTS

Figure 1:
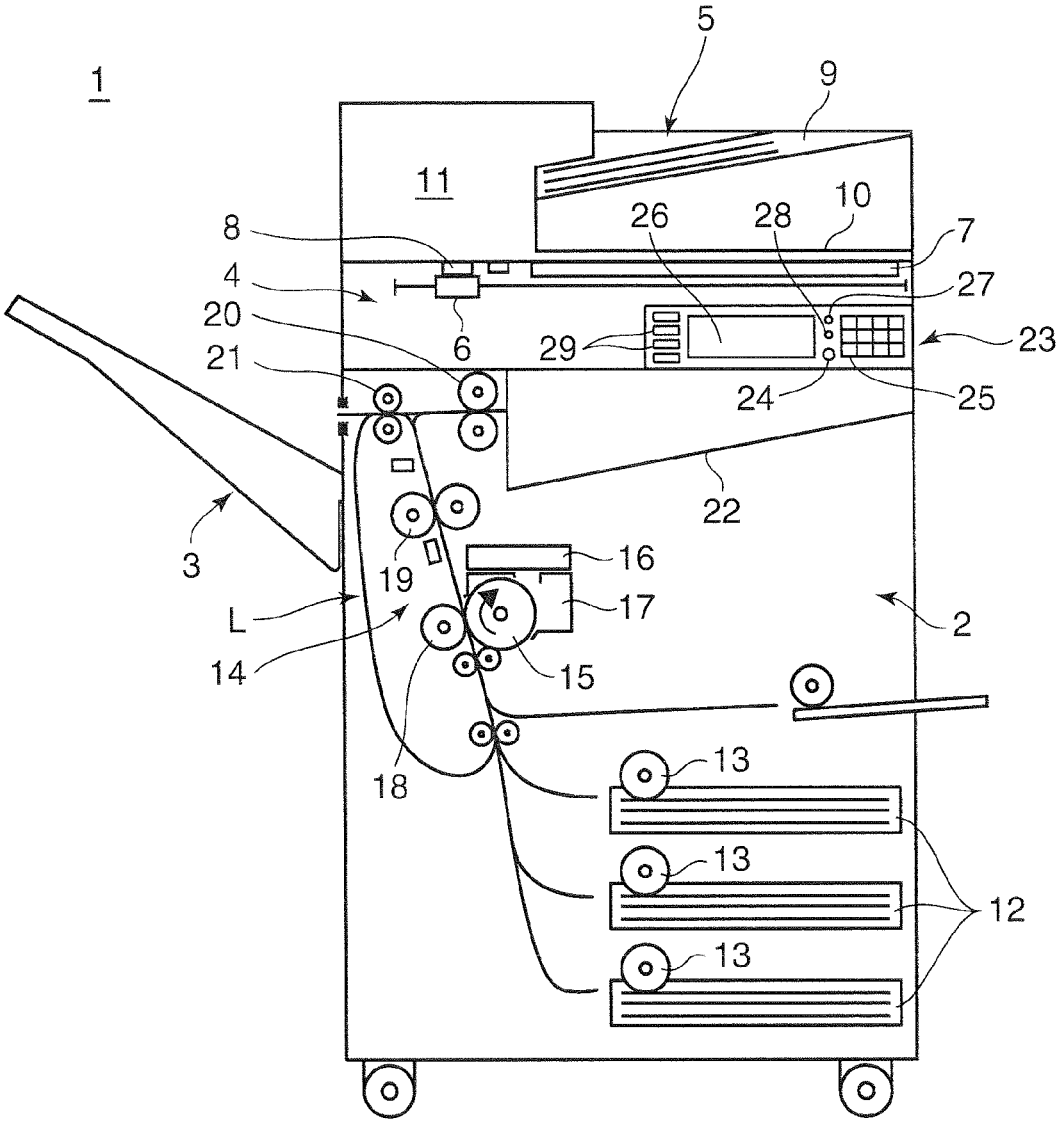
FIG. 1 is a side view showing the internal construction of a complex machine as one embodiment of an image forming apparatus according to the invention.

Hereinafter, one embodiment of an image forming apparatus according to the present invention is described with reference to the drawings. FIG. 1 is a side view showing the internal construction of a complex machine 1 as one embodiment of the image forming apparatus according to the present invention.

The complex machine 1 has a copy function, a printer function, a scanner function, a facsimile function and other functions. The complex machine 1 includes a main body 2, a stack tray 3 arranged on the left side of the main body 2, a document reader 4 arranged atop the main body 2 and a document feeder 5 arranged above the document reader 4.

The document reader 4 is provided with a scanner unit 6 including a CCD (Charge Coupled Device) sensor, an exposure lamp and the like, a document platen 7 formed by a transparent member made of, e.g. glass, and a document reading slit 8. The scanner unit 6 is constructed to be movable by an unillustrated driver. The scanner unit 6 is moved along a document surface at a position facing the document platen 7 and outputs an obtained image data to an unillustrated image processor while scanning a document image in the case of reading a document placed on the document platen 7. The scanner unit 6 is also moved to a position facing the document reading slit 8, obtains a document image in synchronism with a document conveying operation by the document feeder 5 via the document reading slit 8 and outputs an image data of the obtained document image to the image processor in the case of reading the document fed by the document feeder 5.

The document feeder 5 is provided with a document placing portion 9, on which a document is to be placed, a document discharging portion 10, to which a document having an image thereof already read is to be discharged, and a document conveying mechanism 11 comprised of a feed roller (not shown), conveyor rollers (not shown) and the like for dispensing documents placed on the document placing portion 9 one by one, conveying them to the position facing the document reading slit 8 and discharging them to the document discharging portion 10. The document conveying mechanism 11 is also provided with a sheet reversing mechanism (not shown) for reversing a document upside down and conveying it again to the position facing the document reading slit 8, so that images on both sides of the document can be read by the scanner unit 6 via the document reading slit 8.

The document feeder 5 is provided rotatably with respect to the main body 2 so that the front side thereof is movable upward. By exposing the upper surface of the document platen 7 by moving the front side of the document feeder 5 upward, an operator can place a document to be read, e.g. an opened book on the upper surface of the document platen 7.

The main body 2 is provided with a plurality of sheet cassettes 12, feed rollers 13 for dispensing recording sheets one by one from the sheet cassettes 12 and conveying them to an image forming station 14 to be described later, and the image forming station 14 for forming images on recording sheets conveyed from the sheet cassettes 12.

The image forming station 14 is provided with an optical scanning unit 16 for exposing a photoconductive drum 15 by outputting laser beams or the like based on an image data obtained by the scanner unit 6 or the like, a developing unit 17 for developing an electrostatic latent image drawn on a surface of the photoconductive drum 15 to form an image, a transfer unit 18 for transferring the image formed on the photoconductive drum 15 to a recording sheet, a fixing unit 19 for fixing the image to the recording sheet by heating the recording sheet having the image transferred thereto, conveyor rollers 20, 21 disposed in a sheet conveyance path in the image forming station 14 to convey the recording sheet to the stack tray 3 or a discharge tray 22, and the like. In this embodiment, the photoconductive drum is described as an example of an image carrier.

In the case of forming images on both sides of a recording sheet, the recording sheet is nipped between the conveyor rollers 20 at the side of the discharge tray 22 after an image is formed on one side of the recording sheet in the image forming station 14. In this state, the conveyor rollers 20 are rotated in reverse directions to switch back the recording sheet, the recording sheet is conveyed again to a side upstream of the image forming station 14 along a sheet conveyance path L and discharged to the stack tray 3 or the discharge tray 22 after an image is formed on the other side by the image forming station 14.

An operation unit 23 is provided on a front part of the complex machine 1. The operation unit 23 includes a start key 24 operated by a user to input a print instruction, a numerical pad 25 for the input of the number of sets to be printed, a display 26 such as a liquid crystal display having a touch panel function for inputting various settings, a reset key 27 operated to reset set contents and the like set on the display 26, a stop key 28 operated to stop a printing (image forming) operation being performed, and a function switching key 29 operated to switch the copy function, the printer function, the scanner function and the facsimile function.

Figure 2:
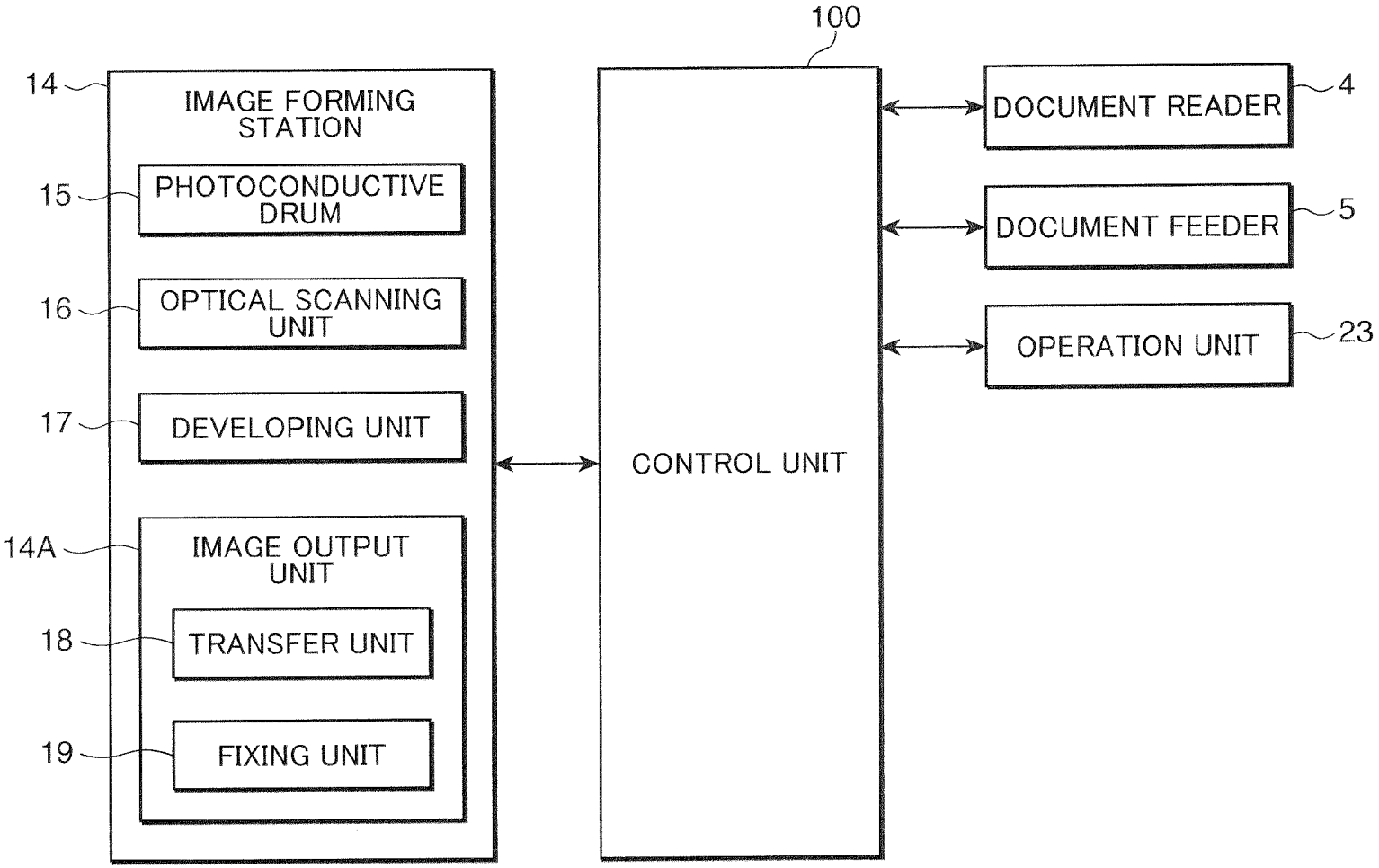
FIG. 2 is a block diagram showing the electrical construction of the complex machine shown in FIG. 1.

FIG. 2 is a block diagram showing the electrical construction of the complex machine 1 shown in FIG. 1. The complex machine 1 is constructed such that the document reader 4, the document feeder 5, the image forming station 14, the operation unit 23 and a control unit 100 are connected with each other via a bus. An image output unit 14A includes the transfer unit 18 and the fixing unit 19 and outputs an image developed by the developing unit 17 by recording it on a recording sheet. Since the constituent elements other than the control unit 100 are described with reference to FIG. 1, they are not described.

The control unit 100 includes a CPU (Central Processing Unit), a ROM (Read Only Memory), a RAM (Random Access Memory), an image memory and the like. The CPU executes controls necessary to operate the complex machine 1 to the above hardware constituting the complex machine 1. The ROM stores software necessary to control the operation of the complex machine 1. The RAM is used to temporarily store data generated during the execution of the software and store application software. The image memory temporarily stores image data (image data output from the document reader 4 or the like), based on which an image is formed in the image forming station 14.

Figure 3:
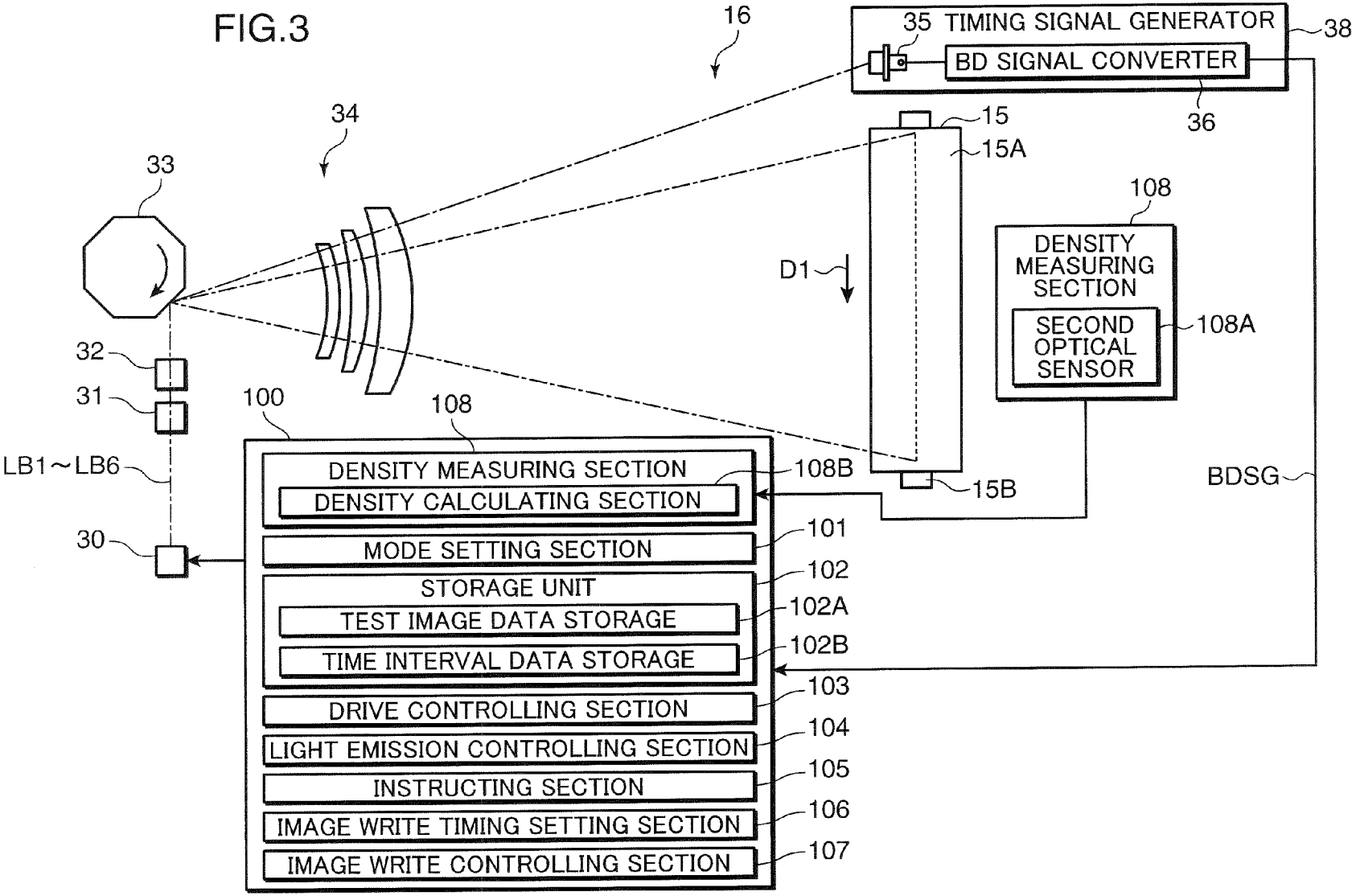
FIG. 3 is a diagram showing constituent elements of an optical scanning unit shown in FIG. 1 and a function block for controlling the optical scanning unit.

FIG. 3 is a diagram showing constituent elements of the optical scanning unit 16 and a function block for controlling the optical scanning unit 16. The optical scanning unit 16 exposes the photoconductive drum 15 with light. The photoconductive drum 15 includes a cylindrical surface 15A and is rotatable about a supporting shaft 15B. An extending direction of the supporting shaft 15B coincides with a main scanning direction D1. The surface 15A of the photoconductive drum 15 is parallel with the main scanning direction D1. The optical scanning unit 16 includes a light source unit 30, a collimator lens 31, a prism 32, a light beam deflector 33, an f-θ lens 34 and a first optical sensor 35 which functions as a beam detect (BD) sensor.

The light source unit 30 is a laser irradiating unit for irradiating light beams to the surface 15A of the photoconductive drum 15 according to an image data. In this embodiment, light beams are laser beams.

Figure 4:
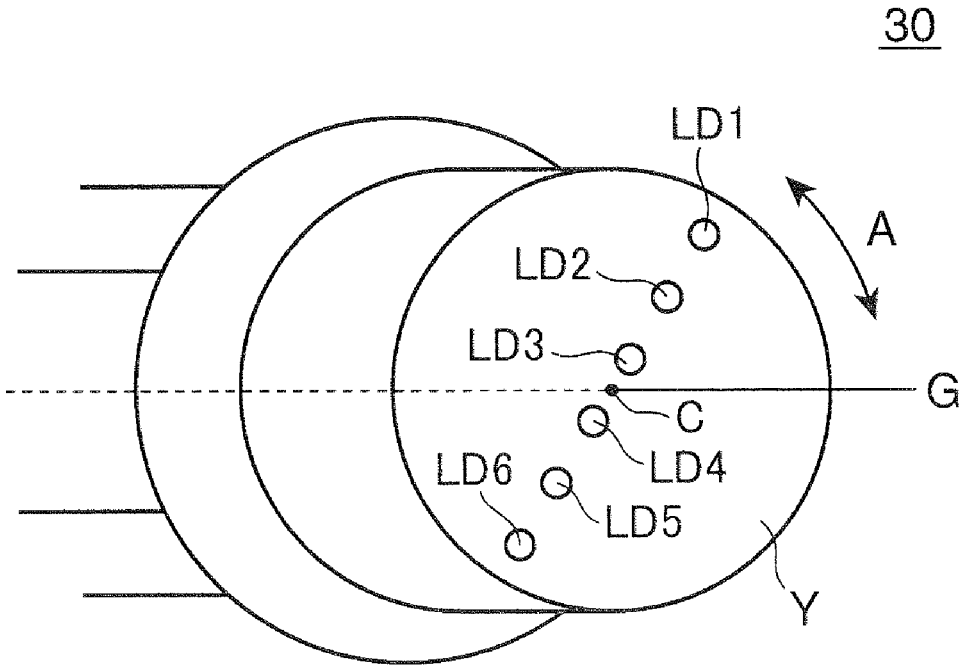
FIG. 4 is a diagram showing an arranged state of a plurality of laser light sources constituting a light source unit shown in FIG. 3.

The light source unit 30 includes a plurality of laser light sources LD1 to LD6 as shown in FIG. 4. In this embodiment, there are six laser light sources. The light source unit 30 irradiates a multi-beam composed of light beams LB1 to LB6 emitted from the plurality of laser light sources LD1 to LD6. In the following description, "the plurality of light beams LB1 to LB6" means the multi-beam. Further, the laser light sources are identified by "LD" in some cases. For example, the laser light sources are identified by LD unless it is necessary to distinguish the respective laser light sources LD1 to LD6.

The light source unit 30 is formed by unitizing the laser light sources LD1 to LD6. Unitization means that the laser light sources LD1 to LD6 are formed on the same semiconductor substrate. The laser light sources LD1 to LD6 are arranged in a row at constant intervals on a tip surface Y of the light source unit 30. The light source unit 30 is rotatable in directions of arrows A about a normal G to the tip surface Y. The normal G passes through a center C (between LD3 and LD4) of the row of the laser light sources LD1 to LD6. The respective laser light sources LD correspond to luminous points and can be individually turned on.

Figure 5:
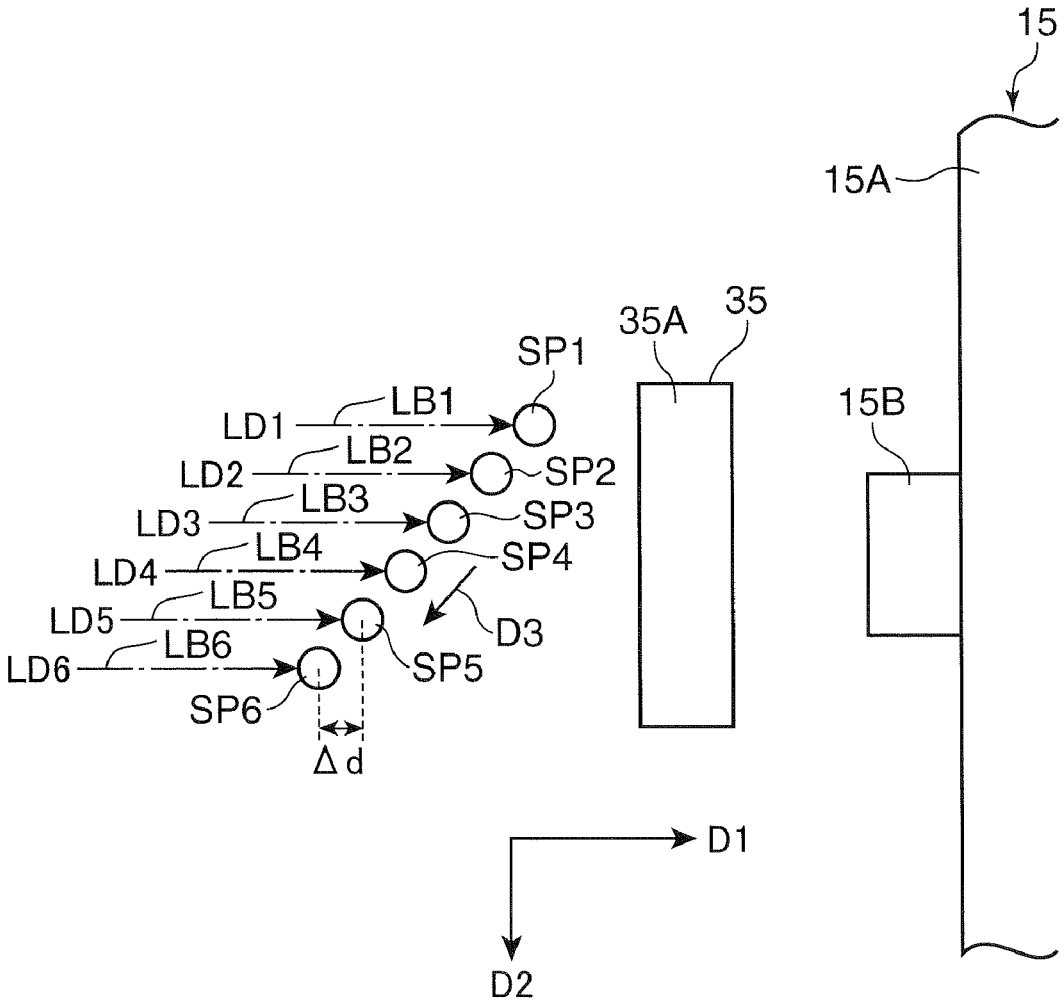
FIG. 5 is a diagram showing a state where light beams output from the respective laser light sources shown in FIG. 4 are imaged at positions different in a main scanning direction and a sub scanning direction on a surface of a photoconductive drum and a light receiving surface of a first optical sensor (BD sensor)

A rotational position of the light source unit 30 in the directions of arrows A is set at a specified position. The specified position is a position where an arrangement direction D3 of beam spots (irradiated positions, points of irradiation) SP1 to SP6 is inclined with respect to the main scanning direction D1 and a sub scanning direction D2 as shown in FIG. 5 when all the laser light sources LD1 to LD6 are simultaneously turned on to irradiate the surface 15A of the photoconductive drum 15 with light beams LB1 to LB6. The row of the laser light sources LD1 to LD6 shown in FIG. 4 can be said to be inclined with respect to the main scanning direction D1 and the sub scanning direction D2.

An electrostatic latent image can be drawn using a plurality of scanning lines by one scanning by setting the light source unit 30 at such a rotational position, and a resolution in the sub scanning direction D2 can be adjusted by adjusting an angle of inclination of the arrangement direction D3. The sub scanning direction D2 is a direction orthogonal to the main scanning direction D1 when the circumferential surface (surface 15A) of the photoconductive drum 15 is unfolded. The light beams are identified by "LB" and the beam spots are identified by "SP" in some cases. For example, the light beams are identified by LB unless it is necessary to distinguish the respective light beams LB1 to LB6. This similarly holds for the beam spots SP.

The collimator lens 31 shown in FIG. 3 collects the light beams LB1 to LB6 output from the laser light sources LD1 to LD6. The prism 32 converts the light beams LB1 to LB6 having passed through the collimator lens 31 into parallel beams and outputs them toward the light beam deflector 33. The light beam deflector 33 deflects the plurality of light beams LB1 to LB6 (multi-beam) emitted from the light source unit 30 in the main scanning direction D1. More specifically, the light beam deflector 33 has a function of a polygon mirror (rotary polygon mirror) and includes a plurality of reflecting surfaces for reflecting incident beams toward the photoconductive drum 15. The light beam deflector 33 is rotated at a constant speed in the direction of arrow of FIG. 3, whereby the light beams LB1 to LB6 scan the photoconductive drum 15 in the main scanning direction D1 while being reflected by the respective reflecting surfaces. The f-θ lens 34 focuses the light beams LB1 to LB6 reflected by the light beam deflector 33 on the surface 15A of the photoconductive drum 15 to form spots having a specified diameter.

By the above construction, the surface 15A of the photoconductive drum 15 is repeatedly scanned with the light beams LB1 to LB6 in the main scanning direction D1 at the constant speed. When the charged surface 15A of the photoconductive drum 15 is irradiated with the light beams LB1 to LB6, electric charges are removed in the irradiated part. An electrostatic latent image is drawn on the surface 15A of the photoconductive drum 15 by the plurality of light beams LB1 to LB6 (multi-beam) deflected in the main scanning direction D1 by the light beam deflector 33. In the complex machine 1, the surface 15A of the photoconductive drum 15 is irradiated with the light beams LB1 to LB6 based on an image data. In this way, an electrostatic latent image is drawn by selectively attenuating the potential of the surface 15A of the photoconductive drum 15, this electrostatic latent image is developed by a developer (toner) and the developed image is transferred to a recording sheet.

A timing signal generator 38 is comprised of the first optical sensor (BD sensor) 35 and a BD signal converter 36. At the starts of image writing operations by the plurality of laser light sources LD, i.e. at the start of drawing an electrostatic latent image on the photoconductive drum 15, the timing signal generator 38 generates timing signals (BD signals BDSG) as bases for the starts of the image writing operations. After the timing signals are output, it is started at a specified timing to draw an electrostatic latent image on the photoconductive drum 15 by the light beams LB1 to LB6 modulated by an image data.

In order to obtain the timing signals (BD signals BDSG), the first optical sensor 35 receives the light beams LB emitted from the plurality of respective laser light sources LD after the light beams LB are deflected by the light beam deflector 33. The timing signal generator 38 generates the timing signals (signals BDSG) in the BD signal converter 36 based on signals output from the first optical sensor 35.

The first optical sensor 35 and the BD signal converter 36 can be described as follows. The first optical sensor 35 is constructed, for example, using photodiodes. The light beams LB1 to LB6 are repeatedly scanned in the main scanning direction D1 in a scanning range longer than the length of the surface 15A of the photoconductive drum 15 by a specified length in the main scanning direction D1. The first optical sensor 35 is disposed at such a position in the scanning range as to receive the light beams LB1 to LB6 before the light beams LB1 to LB6 start passing on the surface 15A of the photoconductive drum 15.

The first optical sensor 35 outputs light reception signals to the BD signal converter 36 upon receiving the light beams LB1 to LB6.

The BD signal converter 36 shapes the light reception signals into BD signals BDSG in the form of rectangular waves, and outputs the BD signals BDSG to the control unit 100. The control unit 100 controls timings to start emitting the light beams LB1 to LB6 generated based on the image data (start timings of the image writing operations; hereinafter, referred to as image write timing).

In the case of generating BD signals BDSG from a plurality of light beams LB (multi-beam) using one first optical sensor 35, the following points have to be noted. When all the laser light sources LD1 to LD6 are simultaneously turned on to irradiate the surface 15A of the photoconductive drum 15 with the light beams LB1 to LB6 as described above with reference to FIG. 5, the arrangement direction D3 of the beam spots SP1 to SP6 of the light beams LB1 to LB6 on the surface 15A of the photoconductive drum 15 and a light receiving surface 35A of the BD sensor 35 is inclined with respect to the main scanning direction D1 and the sub scanning direction D2.

Figures 6A, 6B:
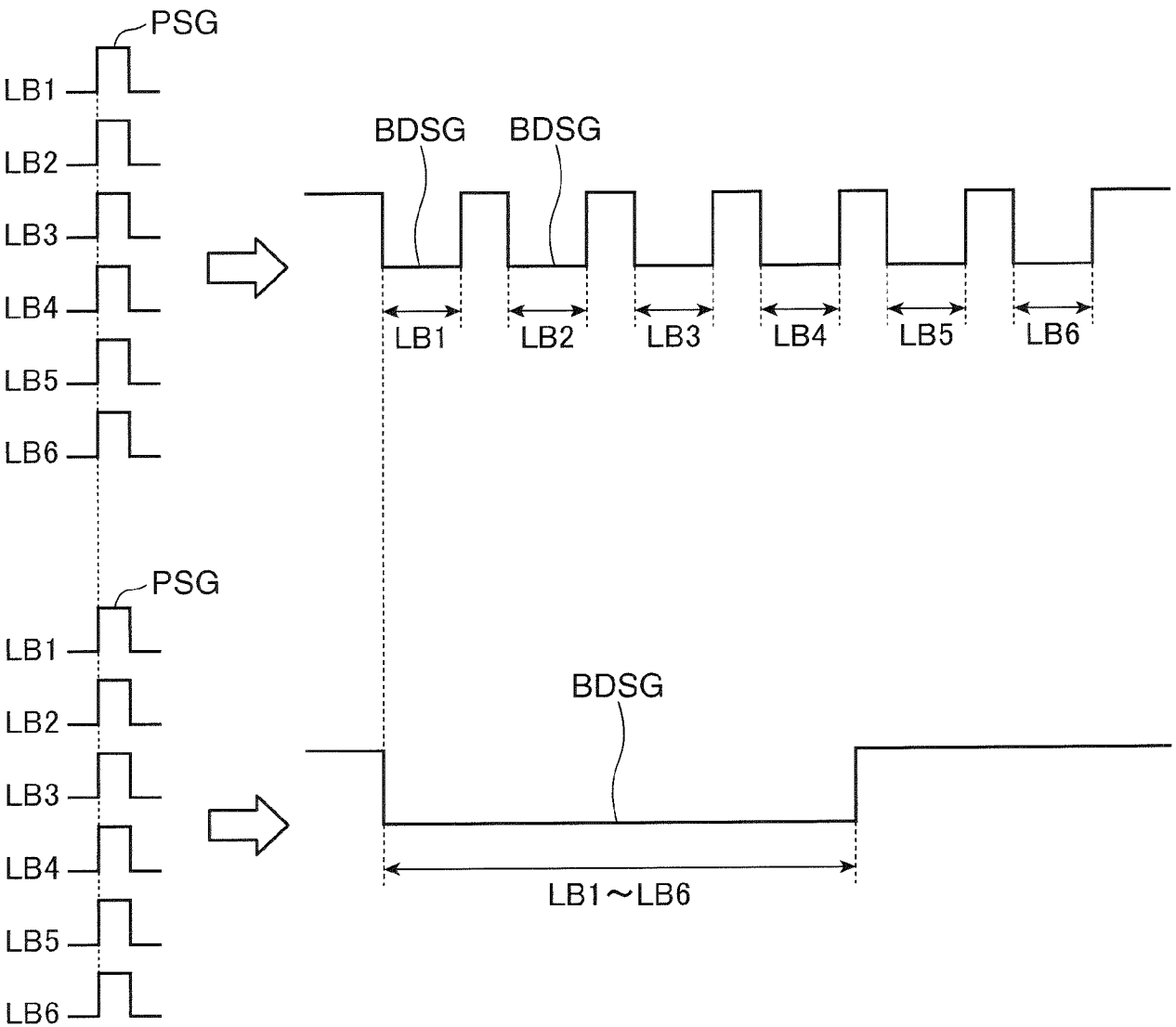
FIGS. 6A and 6B are charts showing that BD signals BDSG differ depending on the size of an interval between beam spots of adjacent light beams.

Thus, when scanning by the light beam deflector (polygon mirror) 33 is performed by causing the laser light sources LD1 to LD6 to simultaneously output pulse signals, the respective light beams LB1 to LB6 arrive at the light receiving surface 35A of the first optical sensor 35 at different timings. In the case of simultaneously outputting pulse signals PSG from the laser light sources LD1 to LD6 as shown in FIG. 6, the BD signals BDSG (timing signals) differ depending on the size of an interval Δd between the beam spots SP of the adjacent light beams LB. If the interval Δd is designed to be large, the BD signals BDSG corresponding to the respective light beams LB1 to LB6 are separately generated at different timings in the timing signal generator 38 as shown in FIG. 6A. Accordingly, timings at which the respective light beams LB1 to LB6 are received by the first optical sensor 35 can be respectively detected.

On the contrary, if the interval Δd is designed to be small, the pulse signal PSG of the next light beam LB is received by the first optical sensor 35 while the pulse signal PSG of the light beam LB received earlier is being received by the first optical sensor 35. In other words, the pulse signal PSG of the next light beam (e.g. LB3) is received by the first optical sensor 35 while the pulse signal PSG of the light beam (e.g. LB2) received earlier by the first optical sensor 35 is moved on the light receiving surface 35A of the first optical sensor 35. Thus, the pulse signal PSG of any one of the light beams LB is constantly incident on the light receiving surface 35A of the first optical sensor 35. Therefore, as shown in FIG. 6B, the BD signal BDSG output from the BD signal converter 36 is a constant signal until the light reception by the first optical sensor 35 is completed for the pulse signal PSG of the last light beam LB.

As a result, the BD signal BDSG can indicate only a reception start timing of the pulse signal PSG of the light beam LB1 first received by the first optical sensor 35 and a reception end timing of the pulse signal PSG of the light beam LB6 received at last. A reception end timing of the pulse signal PSG of the light beam LB1, a reception start timing of the pulse signal PSG of the light beam LB6 and reception end and start timings of the pulse signals PSG of the light beams LB2 to LB5 cannot be known.

Accordingly, a control cannot be executed for the pulse signals PSG of the respective light beams LB1 to LB6 based on the ends of the light receptions by the first optical sensor 35, i.e. end timings of the passages on the light receiving surface 35A. For example, a control cannot be executed to start the image writing operations by the laser light sources LD1 to LD6 at specified timings after the completion of the light receptions.

Thus, the interval Δd is so set beforehand that the BD signals BDSG shown in FIG. 6A can be obtained from the BD signal converter 36. The interval Δd can be adjusted by rotating the light source unit 30 in the direction of arrow A shown in FIG. 4.

As described above, in the case of generating the BD signals BDSG for the plurality of light beams LB (multi-beam) using one first optical sensor 35, a positional relationship of the plurality of laser light sources LD with respect to the first optical sensor 35 is so adjusted that the BD signals BDSG shown in FIG. 6A can be obtained from the BD signal converter 36. In other words, the positional relationship of the plurality of laser light sources LD with respect to the first optical sensor 35 is so adjusted that the timing signals (BD signals BDSG) corresponding to the light beams LB respectively emitted from the plurality of laser light sources LD can be separately generated at different timings in the timing signal generator 38.

Figure 7A:
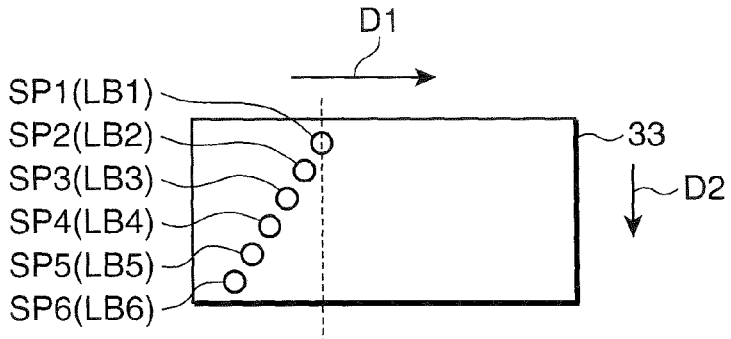
FIGS. 7A and 7B are diagrams showing a multi-beam irradiated to a light beam deflector (polygon mirror) at the starts of image writing operations by the plurality of laser light sources.
Figure 8A:
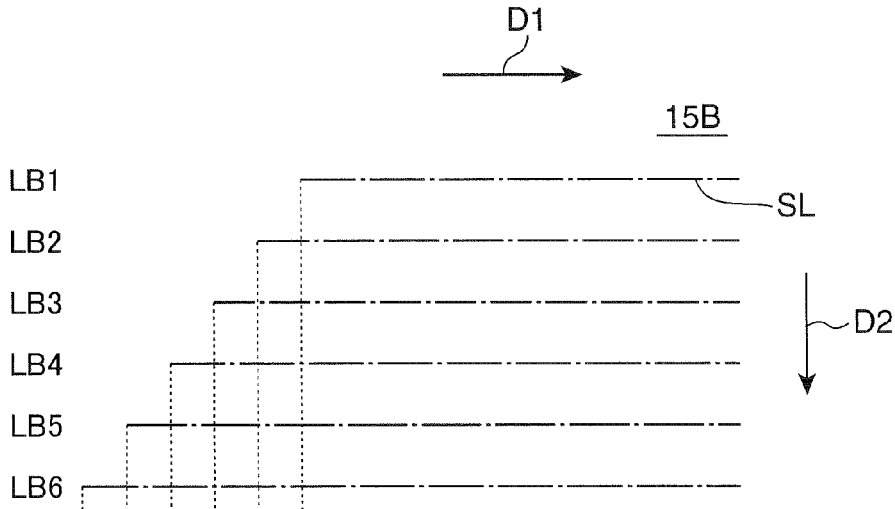
FIGS. 8A and 8B are charts showing image write starting positions of the respective light beams in the main scanning direction at the starts of the image writing operations by the plurality of laser light sources.

However, by setting the interval Δd, image write starting positions of the respective light beams LB in the main scanning direction D1 need to be aligned. This is described. It is assumed that the light beams LB1 to LB6 are output at the same timing from the laser light sources LD1 to LD6 at the starts of the image writing operations by the laser light sources LD1 to LD6. As shown in FIG. 7A, the beam spots SP1 to SP6 of the light beams LB1 to LB6 simultaneously reach the light beam deflector 33. Since the interval Δd is set, the positions of the beam spots SP1 to SP6 in the main scanning direction D1 respectively differ. Thus, image write starting positions x1 to x6 of the respective light beams LB1 to LB6 in the main scanning direction D1 differ on the surface 15A of the photoconductive drum 15 as shown in FIG. 8A. In other words, positions where the formation of main scanning lines SL by the respective light beams LB is started differ.

Figure 7B:
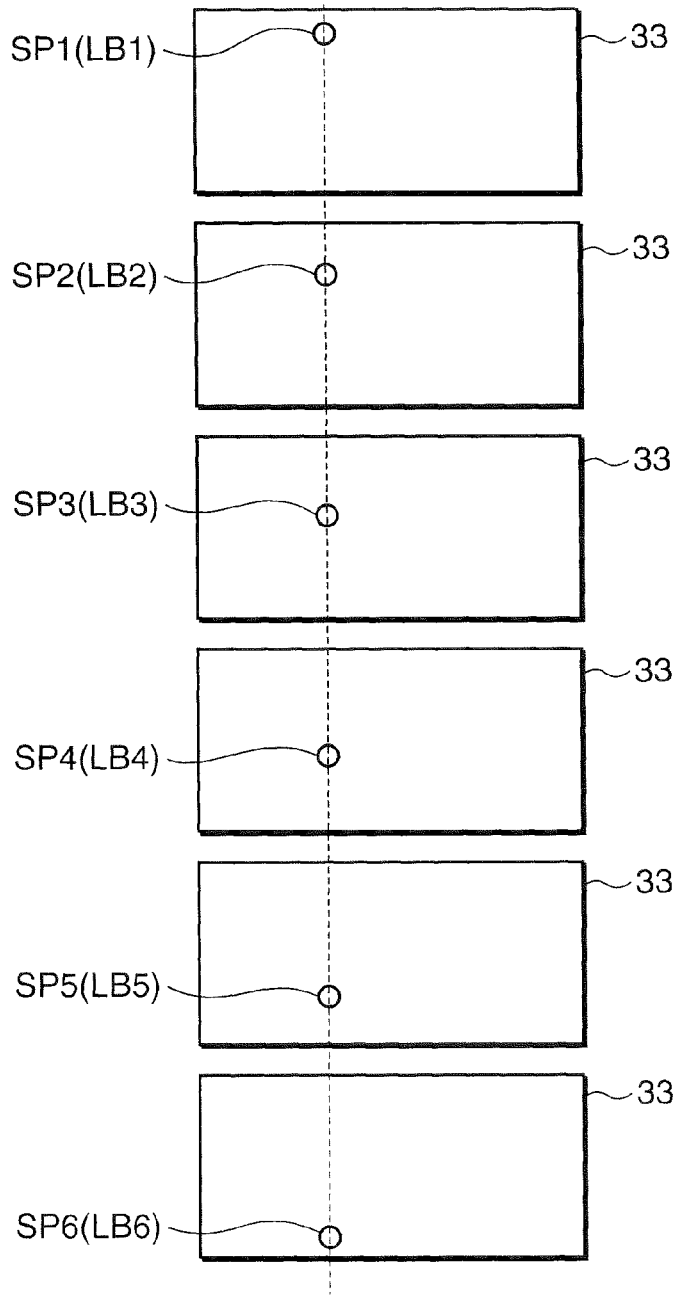
Figure 8B:
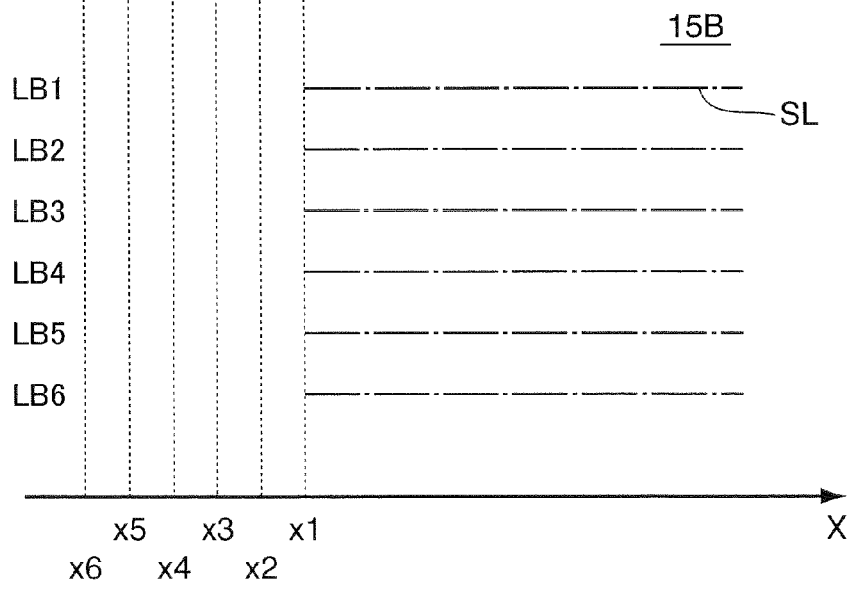

Accordingly, as shown in FIG. 7B, a control is executed to shift the starts of the image writing operations by the laser light sources LD1 to LD6 by a first time interval. This means to shift timings at which the outputs of the light beams LB1 to LB6 from the laser light sources LD1 to LD6 are started. In other words, the image writing operation by the laser light source LD2 is started at the first time interval from the start of the image writing operation by the laser light source LD1, the image writing operation by the laser light source LD3 is started at the first time interval from the start of the image writing operation by the laser light source LD2, the image writing operation by the laser light source LD4 is started at the first time interval from the start of the image writing operation by the laser light source LD3, the image writing operation by the laser light source LD5 is started at the first time interval from the start of the image writing operation by the laser light source LD4, and the image writing operation by the laser light source LD6 is started at the first time interval from the start of the image writing operation by the laser light source LD5. In this way, the beam spots SP1 to SP6 of the light beams LB1 to LB6 have the positions thereof aligned in the main scanning direction D1 by shifting the arrival timings at the light beam deflector 33. As a result, as shown in FIG. 8B, the image write starting positions of the respective light beams LB1 to LB6 in the main scanning direction D1 can be aligned on the surface 15A of the photoconductive drum 15. The above is the description of the adjustment to align the image write starting positions of the respective light beams LB in the main scanning direction D1.

In the optical scanning unit 16, a positional relationship (e.g. the interval Δd between the beam spots SP of the adjacent light beams LB) of arrival points of the respective light beams LB1 to LB6 may change due to an error in mounting the respective elements, maladjustment or a change in the environment of the complex machine 1 (ambient temperature, ambient humidity, etc.). This is a change in intervals of the irradiated positions of the light beams LB1 to LB6 output from the respective laser light sources LD1 to LD6 with the irradiated positions kept arranged in a row.

If the interval Δd changes, the image write starting positions of the respective light beams LB1 to LB6 in the main scanning direction D1 are not aligned.

In this embodiment, in order to deal with such a problem, the image write starting positions of the respective light beams LB1 to LB6 in the main scanning direction D1 are aligned even if the interval Δd changes by adjusting the first time interval (adjusting the start timings of the image writing operations) at the starts of the image writing operations by the laser light sources LD1 to LD6.

The adjustment of the first timing interval in this embodiment is briefly described. As shown in FIG. 3, a control is executed to turn the laser light sources LD1 to LD6 on in a plurality of emission patterns (adjustive scanning patterns) while the surface 15A of the photoconductive drum 15 is moved in the sub scanning direction D2 at such a speed that the next scanning is performed before the surface 15A of the photoconductive drum 15 is moved by the width of one main scanning line in the sub scanning direction D2. The emission pattern means the repetition of specified light emitting operations by the laser light sources LD1 to LD6 as shown in FIG. 9A to 9F. The specified light emitting operation is such an operation as to set a light emission interval each of the laser light sources LD1 to LD6 at a predetermined second time interval T by causing the laser light sources LD1 to LD6 to be successively turned on at the predetermined first time intervals Δt to emit light in the form of pulses during one scanning period by the light beam deflector 33.

Formed electrostatic latent images of test images are respectively developed in a plurality of emission patterns with different first time intervals shown in FIG. 10. The test image having the lowest density is determined out of the developed test images. The first time interval is adjusted based on the first time interval used to draw the electrostatic latent image of this test image. In this way, even if the interval Δd changes, the image write starting positions of the respective light beams LB1 to LB6 in the main scanning direction D1 are aligned. The above is the brief description of the adjustment of the first time interval in this embodiment.

For such an adjustment, the complex machine 1 of this embodiment is provided with functions (mode setting section 101, storage unit 102, drive controlling section (operation controlling section) 103, light emission controlling section (second light emission controlling section) 104, an instructing section 105, an image write timing setting section (first time interval adjusting section) 106, image write controlling section (first light emission controlling section) 107 and density calculating section 108B) realized by the control unit 100 and a second optical sensor 108A. A density measuring section 108 is comprised of the second optical sensor 108A and the density calculating section 108B.

The mode setting section 101 selectively sets the operation mode of the complex machine 1 to a normal operation or a calibration mode. The normal operation mode is a mode in which a normal image forming operation is performed. The calibration mode is a mode in which the first time interval is adjusted.

Figure 11:
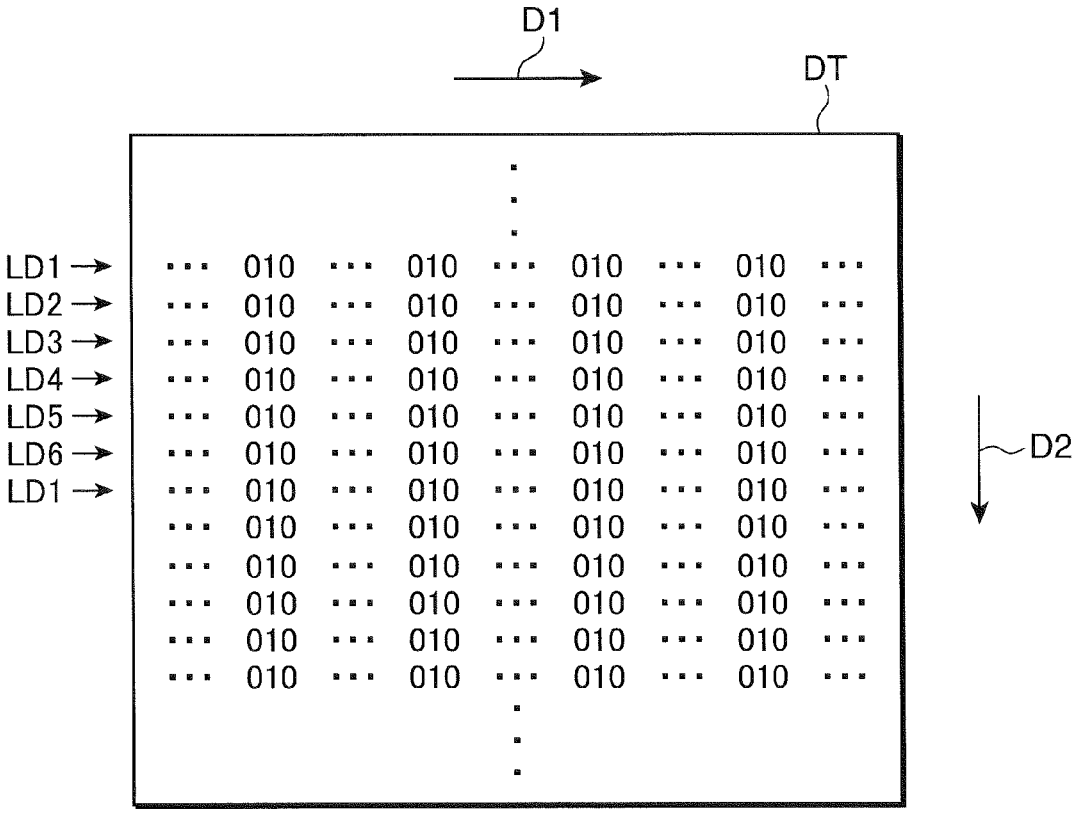
FIG. 11 is a diagram showing an example of a test image data.

The storage unit 102 includes a test image data storage 102A and a time interval data storage 102B. For example, a test image data DT shown in FIG. 11 is stored beforehand in the test image data storage 102A. "0" means one white dot. "1" means one dot of toner color. For example, if the toner color is black, "1" means one black dot. An image formed by one dot of the toner color is called a dot image. Electrostatic latent images of dot images are called dot latent images 53 shown in FIGS. 12 and 13. A row direction is the main scanning direction D1 and a column direction is the sub scanning direction D2.

The test image data DT is such that dot rows each formed by aligning dot images in a row in the sub scanning direction D2 are arranged at predetermined intervals in the main scanning direction D1. The respective laser light sources LD successively emit laser beams LB corresponding to one row data. One row data corresponds to the laser light source LD1, the next row data to the laser light source LD2, the next row data to the laser light source LD3, the next row data to the laser light source LD4, the next row data to the laser light source LD5, the next row data to the laser light source LD6 and the next row data to the laser light source LD1.

The time interval data storage 102B stores values set beforehand as the first time intervals used in controls in the respective emission patterns as shown in FIG. 10. The time interval data storage 102B stores a reference first time interval. The reference first time interval is the first time interval set at a reference time such as shipment from a factory.

If the reference first time interval is assumed to be Δt, the first time interval is set at Δt when mounted states and the like of the respective constituent elements of the optical scanning unit 16 are proper (same as at the time of shipment from the factory) and the environment of the complex machine 1 (ambient temperature, ambient humidity, etc.) are the same as that supposed at the time of shipment from the factory. Under this setting, laser beams LB1 to LB6 modulated by the test image data DT shown in FIG. 11 are emitted from the light source unit 30. This means that the respective laser light sources LD1 to LD6 are turned on to instantaneously emit light (in the form of a pulse). If the respective laser light sources LD2 to LD6 are successively turned on to instantaneously emit light after Δt, 2Δt, 3Δt, 4Δt and 5Δt from the emission timing of the laser light source LD1, arrival points of the respective laser beams LB1 to LB6 are arranged in a row in the sub scanning direction D2 (the arrival points of the respective laser beams are at the same position in the main scanning direction D1). Thus, the image write starting positions of the respective laser beams LB1 to LB6 in the main scanning direction D1 are aligned.

In addition to the reference first time interval, time intervals (Δt+Δα), (Δt+2Δα), (Δt−Δα) and (Δt−2Δα) increased or decreased by specified amounts from the reference first time interval Δt are stored in the time interval data storage 102B.

The image write controlling section (first light emission controlling section) 107 shown in FIG. 3 is a controlling section used in the normal operation mode. The image write controlling section 107 executes a control to shift the starts of the image writing operations by the plurality of laser light sources LD by the first time interval when an electrostatic latent image is drawn on the surface 15A of the photoconductive drum 15 by a plurality of laser beams LB emitted from the light source unit 30 in accordance with the BD signals BDSG (timing signals) generated in the timing signal generator 38.

In this way, the image write starting positions of the respective laser beams LB1 to 1B6 are aligned in the main scanning direction D1. The first time interval used for the control in the image write controlling section 107 is stored beforehand in the time interval data storage 102B.

The drive controlling section (operation controlling section) 103 controls the operation of an unillustrated motor for rotating and driving the photoconductive drum 15. In this embodiment, when the calibration mode is set by the mode setting section 101, the above motor is controlled to rotate the photoconductive drum 15 at a specified rotating speed slower than that in the normal operation mode. Specifically, the photoconductive drum 15 is rotated at such a speed that the next scanning is performed before the surface 15A of the photoconductive drum 15 moves in the sub scanning direction D2 by the width of one main scanning line.

The light emission controlling section (second light emission controlling section) 104 is a controlling section used in the calibration mode (first time interval adjustment mode). The light emission controlling section 104 executes controls of the emission patterns 1 to 5 shown in FIG. 10. Specifically, the light emission controlling section 104 executes a control to draw an electrostatic latent image of the test image with the photoconductive drum 15 rotated by the drive controlling section 103 (with a photoconductive member moved). The control to draw the electrostatic latent image of the test image is a control to cause the light source unit 30 to emit laser beams LB1 to LB6 (multi-beam) modulated by the test image data DT stored in the test image data storage 102A based on the BD signals BDSG (timing signals) generated in the timing signal generator 38 and cause the laser beam deflector 33 to deflect the laser beams, thereby forming the electrostatic latent image of the test image on the surface 15A of the photoconductive drum 15. The light emission controlling section 104 executes a control to draw electrostatic latent images of a plurality of test images with different first time intervals.

For example, in the control of the emission pattern 1, the first time intervals (start timings of the image writing operations by the laser light sources LD1 to LD6) are shifted by Δt. This is to align the image write starting positions of the respective laser beams LB1 to LB6 in the main scanning direction D1 as described with reference to FIGS. 7A, 7B and 8A, 8B. An emission control of the emission pattern 1 is a control shown in FIG. 9A to 9F. An emission interval of the laser light source LD1, that of the laser light source LD2, that of the laser light source LD3, that of the laser light source LD4, that of the laser light source LD5 and that of the laser light source LD6 are the same. This interval is called the second time interval T.

Figure 12:
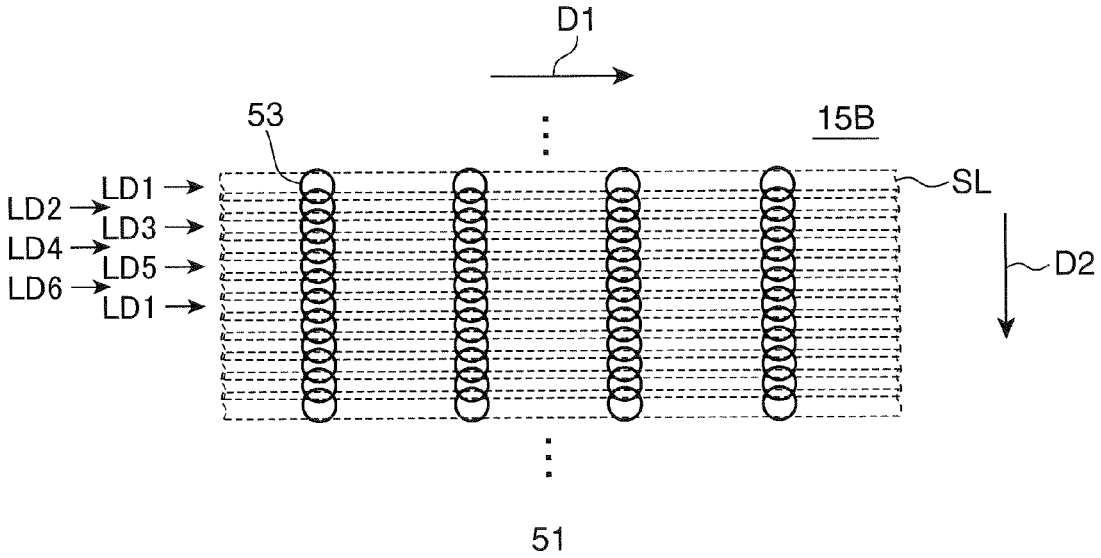
FIG. 12 is a diagram showing an example of an electrostatic latent image of a test image drawn in a first time interval adjustment mode.
Figure 13:
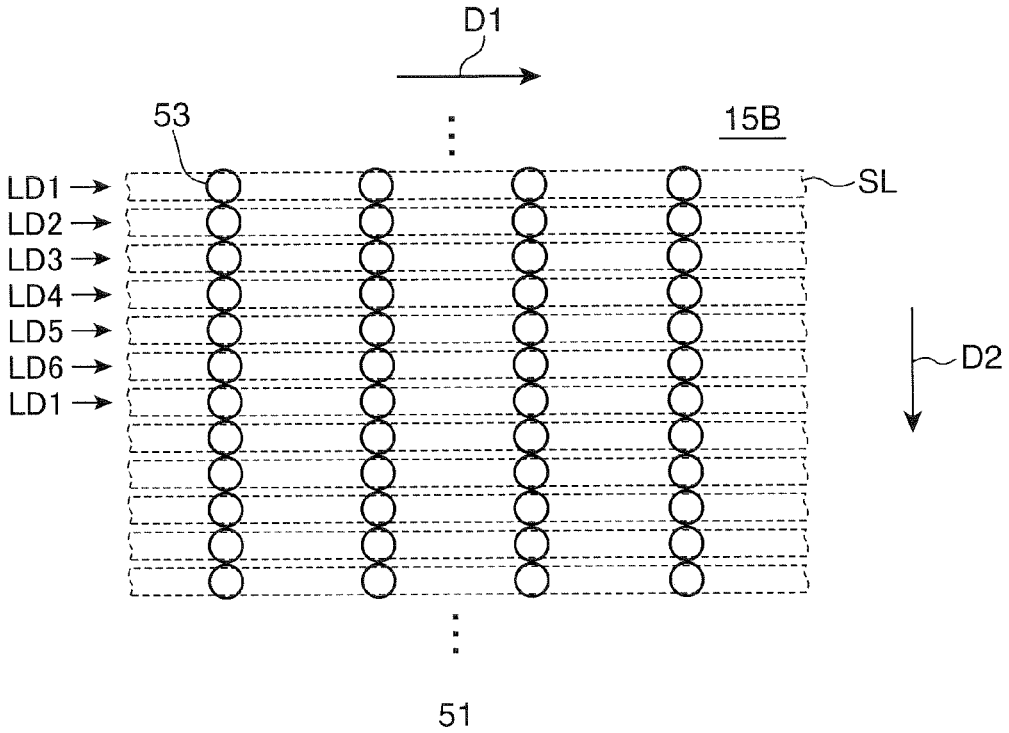
FIG. 13 is a diagram showing an example of an electrostatic latent image of a test image drawn in a normal operation mode.

In the case of executing the control of the emission pattern 1 for the test image data DT shown in FIG. 11 with the interval Δd between the beam spots SP shown in FIG. 5 remaining unchanged, an electrostatic latent image 51 of the test image shown in FIG. 12 is obtained. An electrostatic latent image 51 of the test image drawn in the normal operation mode is shown in FIG. 13 for comparison. The electrostatic latent image 51 of the test image is formed on the surface 15A of the photoconductive drum 15. Identified by SL are main scanning lines. By developing the electrostatic latent image 51 of the test image, the test image is obtained.

In the calibration mode (first time interval adjustment mode), the photoconductive drum 15 is rotated at such a speed that the next scanning is performed before the surface 15A of the photoconductive drum 15 moves in the sub scanning direction D2 by the width of one main scanning line SL by the control of the drive controlling section 103. Accordingly, dot latent images 53 adjacent in the sub scanning direction D2 overlap as shown in FIG. 12. The dot latent image 53 is an electrostatic latent image of a dot image (one dot image).

The main scanning line SL in one row is a main scanning line formed by the laser beam LB1 emitted from the laser light source LD1, the main scanning line in the next row is a main scanning line formed by the laser beam LB2 emitted from the laser light source LD2, the main scanning line in the next row is a main scanning line formed by the laser beam LB3 emitted from the laser light source LD3, the main scanning line in the next row is a main scanning line formed by the laser beam LB4 emitted from the laser light source LD4, the main scanning line in the next row is a main scanning line formed by the laser beam LB5 emitted from the laser light source LD5, the main scanning line in the next row is a main scanning line formed by the laser beam LB6 emitted from the laser light source L6, and the main scanning line in the next row is a main scanning line formed by the laser beam LB1 emitted from the laser light source LD1.

Since there is no change in the interval Δt shown in FIG. 5, the image write starting positions of the respective laser beams LB1 to LB6 can be aligned in the main scanning direction D1 on the surface 15A of the photoconductive drum 15. Thus, the dot latent images 53 are not displaced in the main scanning direction D1 and, hence, are arranged in rows in the sub scanning direction D2.

The light emission controlling section 104 can be also described as follows. An operation of causing the respective laser light sources LD1 to LD6 to successively emit light in the form of a pulse at the first time intervals is performed a plurality of times at the preset second time intervals T during one scanning period. This is called a light emission operation. A series of light emission operations performed in a plurality of main scannings are called an emission pattern. There are a plurality of emission patterns with different first time intervals.

Figures 9A, 9B, 9C, 9D, 9E, 9F:
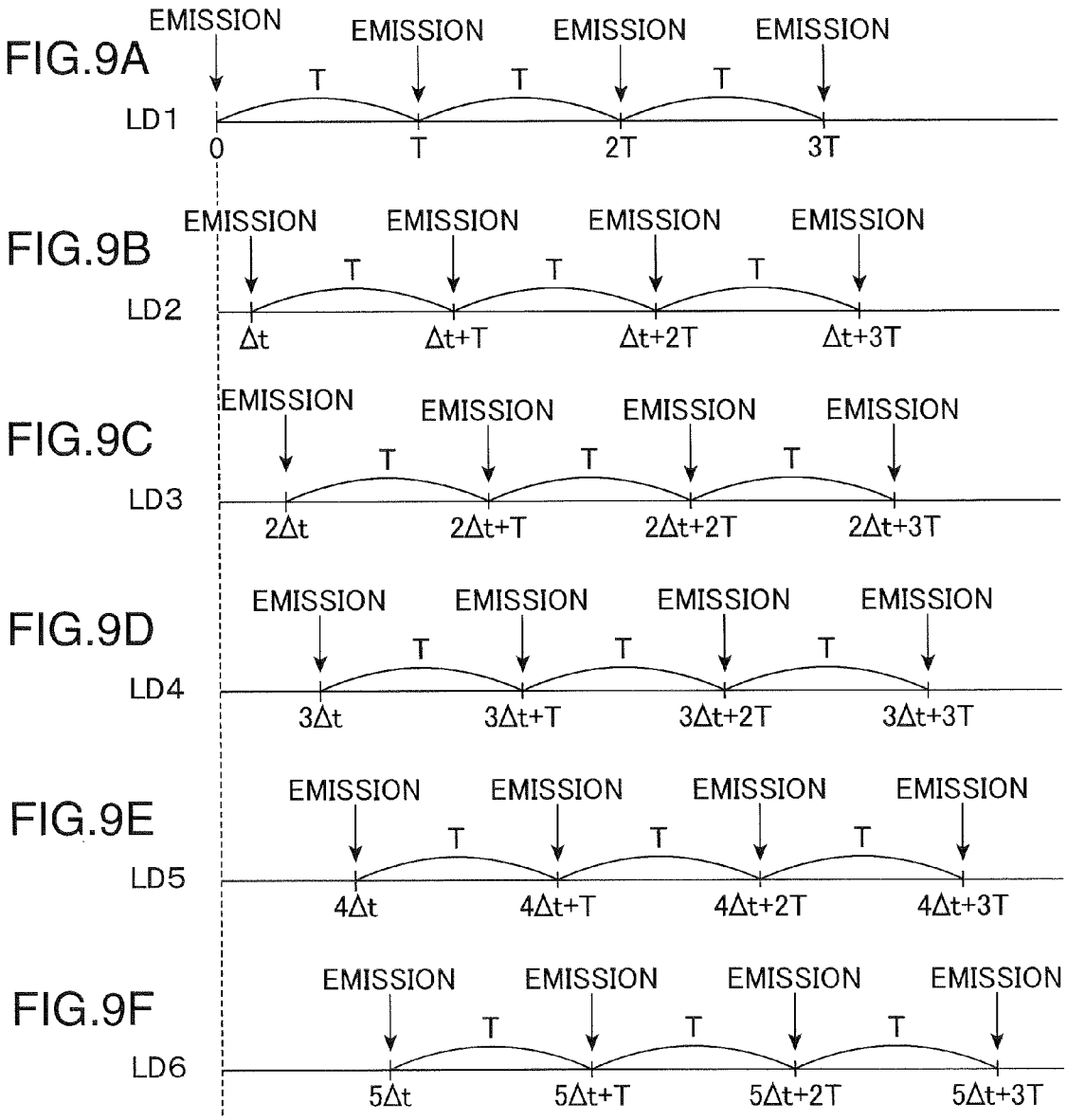
FIGS. 9A to 9F are charts showing a control of an emission pattern 1 executed by an light emission controlling section (second light emission controlling section) shown in FIG. 3.

Specifically, as shown in FIGS. 9 and 10, the light emission controlling section 104 first executes the control of the emission pattern 1 with the first time interval Δt. In other words, the light emission controlling section 104 causes the beam spot SP1 of the laser beam LB1 to pass on the light receiving surface 35A of the first optical sensor 35 by turning the laser light source LD1 on. The BD signal converter 36 causes the laser light source LD1 to instantaneously emit light upon the lapse of a predetermined standby period from a timing of receiving the BD signal BDSG from the first optical sensor 35. Subsequently, as shown in FIG. 9A to 9F, the light emission controlling section 104 causes the laser light source LD1 to instantaneously emit light at the predetermined second time interval T (T, 2T, 3T) from this emission timing. The light emission controlling section 104 causes the instantaneous light emission operations of the laser light source LD1 at the above emission timings to be performed in a plurality main scanning lines SL.

The light emission controlling section 104 causes the laser light source LD2 to instantaneously emit light at timings after the first time interval Δt from the respective emission timings by the laser light source LD1. Further, the light emission controlling section 104 causes the laser light source LD3 to instantaneously emit light at timings after the first time interval Δt from the respective emission timings by the laser light source LD2, causes the laser light source LD4 to instantaneously emit light at timings after the first time interval Δt from the respective emission timings by the laser light source LD3, causes the laser light source LD5 to instantaneously emit light at timings after the first time interval Δt from the respective emission timings by the laser light source LD4, and causes the laser light source LD6 to instantaneously emit light at timings after the first time interval Δt from the respective emission timings by the laser light source LD6.

Further, the light emission controlling section 104 executes a control of the emission pattern 2 with the first time interval (Δt+Δα), a control of the emission pattern 3 with the first time interval ((Δt+2Δα), a control of the emission pattern 4 with the first time interval (Δt−Δα) and a control of the emission pattern 5 with the first time interval (Δt−2Δα) similar to the control of the emission pattern 1.

For example, the control of the emission pattern 5 is similar to that of the emission pattern 1 in the emission control of the laser light source LD1. The laser light source LD2 is caused to instantaneously emit light at timings after the first time interval ((Δt−2Δα) from the respective emission timings by the laser light source LD1, the laser light source LD3 is caused to instantaneously emit light at timings after the first time interval ((Δt−2Δα) from the respective emission timings by the laser light source LD2, the laser light source LD4 is caused to instantaneously emit light at timings after the first time interval ((Δt−2Δα) from the respective emission timings by the laser light source LD3, the laser light source LD5 is caused to instantaneously emit light at timings after the first time interval ((Δt−2Δα) from the respective emission timings by the laser light source LD4, and the laser light source LD6 is caused to instantaneously emit light at timings after the first time interval ((Δt−2Δα) from the respective emission timings by the laser light source LD5. The above is the description of the operation of the light emission controlling section 104.

In such controls of the emission patterns 1 to 5, dot latent image columns 55 shown in FIGS. 14A to 14E are formed when the arrival points (irradiation areas) of the respective beams do not overlap by the operation of successively causing the respective laser light sources LD1 to LD6 to instantaneously emit light at the predetermined first time intervals. The dot latent image column 55 is such that as many dot electrostatic latent images (hereinafter, merely referred to as dots) as luminous points are arranged in a row in a direction intersecting with the main scanning direction D1. The dot latent image column 55 is a column of the dot latent images 53 shown in FIGS. 12 and 13.

By performing this operation a plurality of times at the predetermined second time intervals T during one scanning period, a plurality of dot latent image columns 55 are formed in the main scanning direction D1 while being spaced apart by a distance R (see FIG. 14A) corresponding to the second time interval T.

By controlling the laser light sources LD1 to LD6 by the emission patterns 1 to 5 while moving the surface 15A of the photoconductive drum 15 in the sub scanning direction D2 such that the next scanning is performed before the surface 15A of the photoconductive drum 15 moves in the sub scanning direction D2 by the width of one main scanning line SL, electrostatic latent image areas 57 shown in FIGS. 14A to 14E are formed. The electrostatic latent image area 57 is such that a plurality of dot latent image columns 55 overlap in the sub scanning direction D2. A plurality of electrostatic latent image areas 57 are formed while being spaced apart by the distance R. An electrostatic latent image 51 of the test image is formed by a plurality of electrostatic latent image areas 57. The electrostatic latent image 51 of the test image shown in FIG. 14A corresponds to the electrostatic latent image 51 of the test image shown in FIG. 12. Electrostatic latent images 51 of the test images shown in FIGS. 14A to 14E are developed into test images by the developing unit 17 shown in FIG. 1. Thus, the developing unit 17 has a function of developing the electrostatic latent image 51 of the test image formed on the surface 15A of the photoconductive drum 15 by the second light emission controlling section.

Figure 14A:
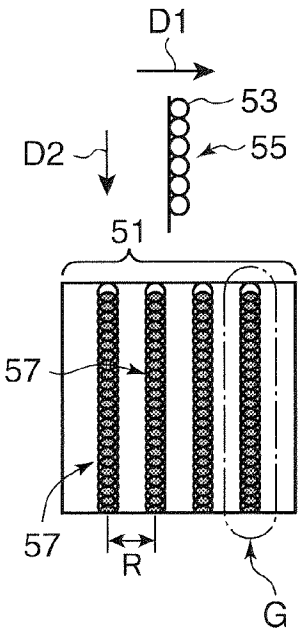
FIGS. 14A to 14E are diagrams showing examples of an electrostatic latent image of a test image obtained in a calibration mode (first time interval adjustment mode)
Figure 14B:
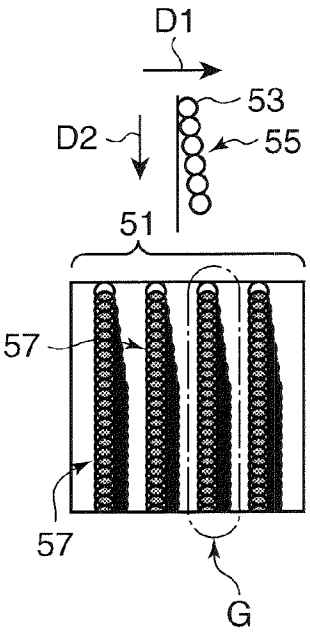

If the interval Δt shown in FIG. 5 changes, the dot latent image column 55 shown in FIG. 14A cannot be obtained even if the control of the emission pattern 1 is executed, and becomes the dot latent image 55 shown in FIG. 14B to 14E. This is because the image write starting positions of the respective laser beams LB1 to LB6 are displaced in the main scanning direction D1 without being aligned in the main scanning direction D1.

By rotating and driving the photoconductive drum 15 at the low speed described above, the dot latent image columns adjacent in the sub scanning direction D2 overlap as shown in FIGS. 14B to 14E. As a result, in the cases of FIGS. 14B to 14E, strip-like straight images G (electrostatic latent image areas 57) thicker than straight images G (electrostatic latent image areas 57) shown in FIG. 14A are formed on the surface 15A of the photoconductive drum 15. Further, these straight images G are formed side by side at the constant intervals R in the main scanning direction D1.

Here, distances between the arrival points of the respective laser beams LB1 to LB6 change according to the duration of the first time interval. In other words, the image write starting positions of the laser beams LB1 to LB6 in the main scanning direction D1 changes. Since an angle between the respective dot latent image columns 55 and the sub scanning direction D2 increases as the first time interval increases, the straight images G become thicker. This is described with reference to FIGS. 15A and 15B. If the angle between the respective dot latent image columns 55 and the sub scanning direction D2 increases, overlapping areas with the adjacent dot latent image column 55 become smaller (FIG. 15B) and the straight image G becomes thicker. On the contrary, if the angle between the respective dot latent image columns 55 and the sub scanning direction D2 decreases, the overlapping areas with the adjacent dot latent image column 55 become larger (FIG. 15A) and the straight image G becomes thinner.

Figure 15A:
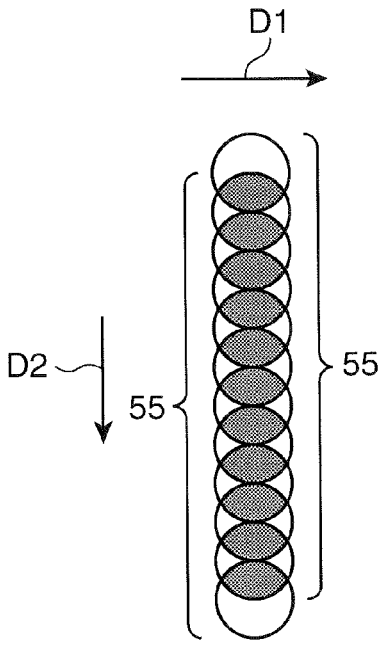
FIGS. 15A and 15B are diagrams showing examples of an overlapping state of two dot latent image rows.
Figure 15B:
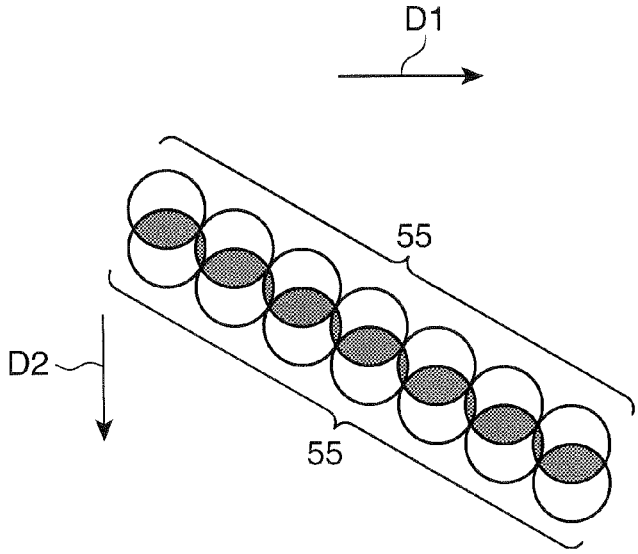

FIG. 15A is a diagram showing an overlapping state of two of a plurality of dot latent image columns 55 arranged in the sub scanning direction D2 when the respective dot latent image columns 55 are parallel with the sub scanning direction D2. FIG. 15B is a diagram showing an overlapping state of two of a plurality of dot latent image columns 55 arranged in the sub scanning direction D2 when the respective dot latent image columns 55 are oblique to the sub scanning direction D2.

The test images obtained by developing the electrostatic latent images 51 of the test images shown in FIGS. 14A to 14E have the densities thereof measured by the density measuring section 108 shown in FIG. 3. The density measuring section 108 includes the second optical sensor 108A and the density calculating section 108B. The second optical sensor 108A includes a light emitting portion and a light receiving portion. Light is irradiated from the light emitting portion to the test image developed on the surface 15A of the photoconductive drum 15 and the light reflected from the test image is received by the light receiving portion.

A beam spot of the light emitted from the light emitting portion has such a size as to cover the entire test image. Accordingly, the amount of the light reflected from the test image decreases as the straight image G (image corresponding to the electrostatic latent image area 57) becomes thicker, wherefore the density of the test image becomes higher. Conversely, the amount of the light reflected from the test image increases as the straight image G becomes thinner, wherefore the density of the test image becomes lower. The light receiving portion outputs a signal corresponding to the amount of the received light. This signal is sent to the density calculating section 108B to calculate the density of the test image.

Figure 14C:
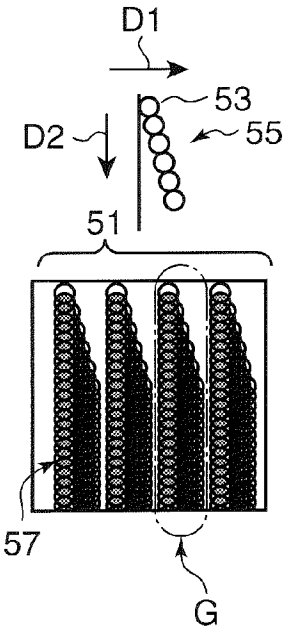
Figure 14D:
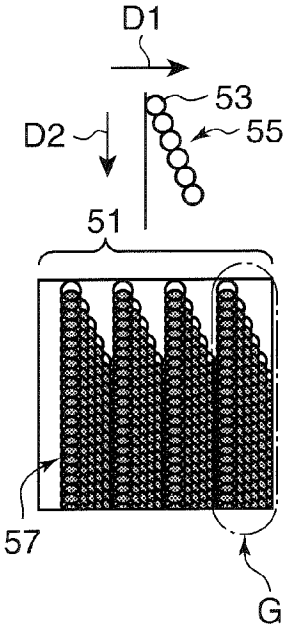

If the densities of the straight images G differ, the densities of the respective test images cannot be accurately compared. For example, if the density of the straight images G shown in FIG. 14C is higher than that of the straight images G shown in FIG. 14D, the density of the test image corresponding to the electrostatic latent image 51 shown in FIG. 14C may be possibly judged to be higher than that of the test image corresponding to the electrostatic latent image 51 shown in FIG. 14D.

Accordingly, in the control of the light emission controlling section (second light emission controlling section) 104, the electrostatic latent image 51 of the test image is drawn with the amount of light at which the density of overlapping dot images and that of non-overlapping dot images are equal. In this way, the densities of the straight images G shown in FIGS. 14A to 14E are set equal. The dot image is an image of one dot obtained by developing the dot latent image 53.

Figure 14E:
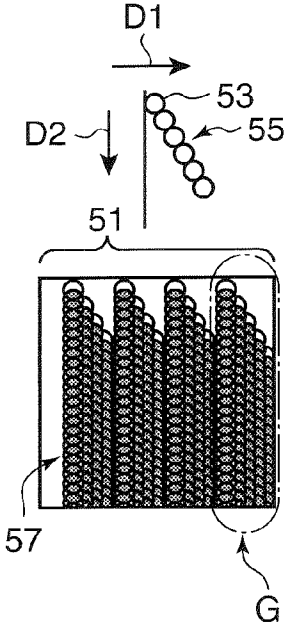

In FIGS. 14A to 14E, the density of the test image developed from the electrostatic latent image 51 of the test image shown in FIG. 14E is highest and that of the test image developed from the electrostatic latent image 51 of the test image shown in FIG. 14A is lowest. It can be understood that the density of the test image becomes lower as the inclination of the dot latent image columns 55 with respect to the sub scanning direction D2 decreases. The density of the test image is lowest when the direction of the dot latent image columns 55 coincides with the sub scanning direction D2 as shown in FIG. 14A. The case where the direction of the dot latent image columns 55 coincides with the sub scanning direction D2 means the case where the image write starting positions of the respective laser beams LB1 to LB6 are aligned in the main scanning direction D1.

Thus, the first time interval used to draw the electrostatic latent image of the test image having the lowest density is understood to be the first time interval with which the image write starting positions of the respective laser beams LB1 to LB6 output from the respective laser light sources LD1 to LD6 can be aligned or substantially aligned.

When the image write starting positions of the respective laser beams LB1 to LB6 are no longer aligned in the main scanning direction D1 due to a change in the interval Δd between the beam spots SP shown in FIG. 5, the image write starting positions can be aligned or substantially aligned if the first time interval used to draw the electrostatic latent image of the test image having the lowest density is set.

In this embodiment, the first time interval is adjusted based on the test image density measurement described above. First of all, the light emission controlling section 104 executes controls of a plurality of emission patterns with different first time intervals. The instructing section 105 instructs the developing unit 17 to develop the electrostatic latent image 51 of the test image formed on the surface 15A of the photoconductive drum 15 by the control of each emission pattern. The instructing section 105 instructs the density measuring section 108 to measure the density of the test image.

The image write timing setting section (first time interval adjusting section) 106 compares the densities of the test images in the respective emission patterns measured by the density measuring section 108 and judges the test image having the lowest density. Based on the first time interval used to draw the electrostatic latent image 51 of this test image, the first time interval used for the control in the image write controlling section 107 and stored in the time interval data storage 102B is adjusted.

For example, it is assumed that the electrostatic latent images 51 of the test images drawn by the controls of the respective emission patterns are the electrostatic latent images 51 shown in FIGS. 14A to 14E and the electrostatic latent image 51 drawn with the reference first time interval Δt set is the electrostatic latent image 51 shown in FIG. 14C. The electrostatic latent images 51 obtained in the respective emission patterns 2 to 5 with the first time interval respectively set at (Δt+Δα), (Δt+2Δα), (Δt−Δα) and (Δt−2Δα) are the electrostatic latent images 51 shown in FIGS. 14D, 14E, 14B and 14A. Accordingly, the image write timing setting section 106 sets the first time interval (Δt−2Δα) used to draw the electrostatic latent image 51 shown in FIG. 14A and having the lowest density as the first time interval used for the emission control in the normal operation mode (control in the image write controlling section 107).

The image write controlling section (first light emission controlling section) 107 adjusts the start timings of the image writing operations based on the image data for the respective laser light sources LD1 to LD6 by the first time interval adjusted by the image write timing setting section 106.

Specifically, in the case of setting the first time interval (Δt−2Δα) used to draw the electrostatic latent image 51 shown in FIG. 14A as a time interval between the image write start timings by the respective laser light sources LD1 to LD6 as in the above example, the following control is executed. The image write controlling section 107 turns the laser light source LD1 on to pass the laser beam LB1 on the light receiving surface 35A of the first optical sensor 35. At this time, the image write controlling section 107 causes the laser light source LD1 to start the image writing operation based on the image data upon the lapse of the predetermined standby period from the receiving timing of the BD signal BDSG output from the BD signal converter 36.

Further, the image write controlling section 107 causes the laser light source LD2 to start the image writing operation based on the image data upon the lapse of the period (Δt−2Δα) from the starting time of the image writing operation by the laser light source LD1 based on the image data, causes the laser light source LD3 to start the image writing operation based on the image data upon the lapse of the period (Δt−2Δα) from the starting time of the image writing operation by the laser light source LD2 based on the image data, causes the laser light source LD4 to start the image writing operation based on the image data upon the lapse of the period (Δt−2Δα) from the starting time of the image writing operation by the laser light source LD3 based on the image data, causes the laser light source LD5 to start the image writing operation based on the image data on the lapse of the period (Δt−2Δα) from the starting time of the image writing operation by the laser light source LD4 based on the image data, and causes the laser light source LD6 to start the image writing operation based on the image data upon the lapse of the period (Δt−2Δα) from the starting time of the image writing operation by the laser light source LD5 based on the image data.

In this way, the image write starting positions of the respective laser beams LB1 to LB6 can be aligned or substantially aligned in the main scanning direction D1.

Figure 16:
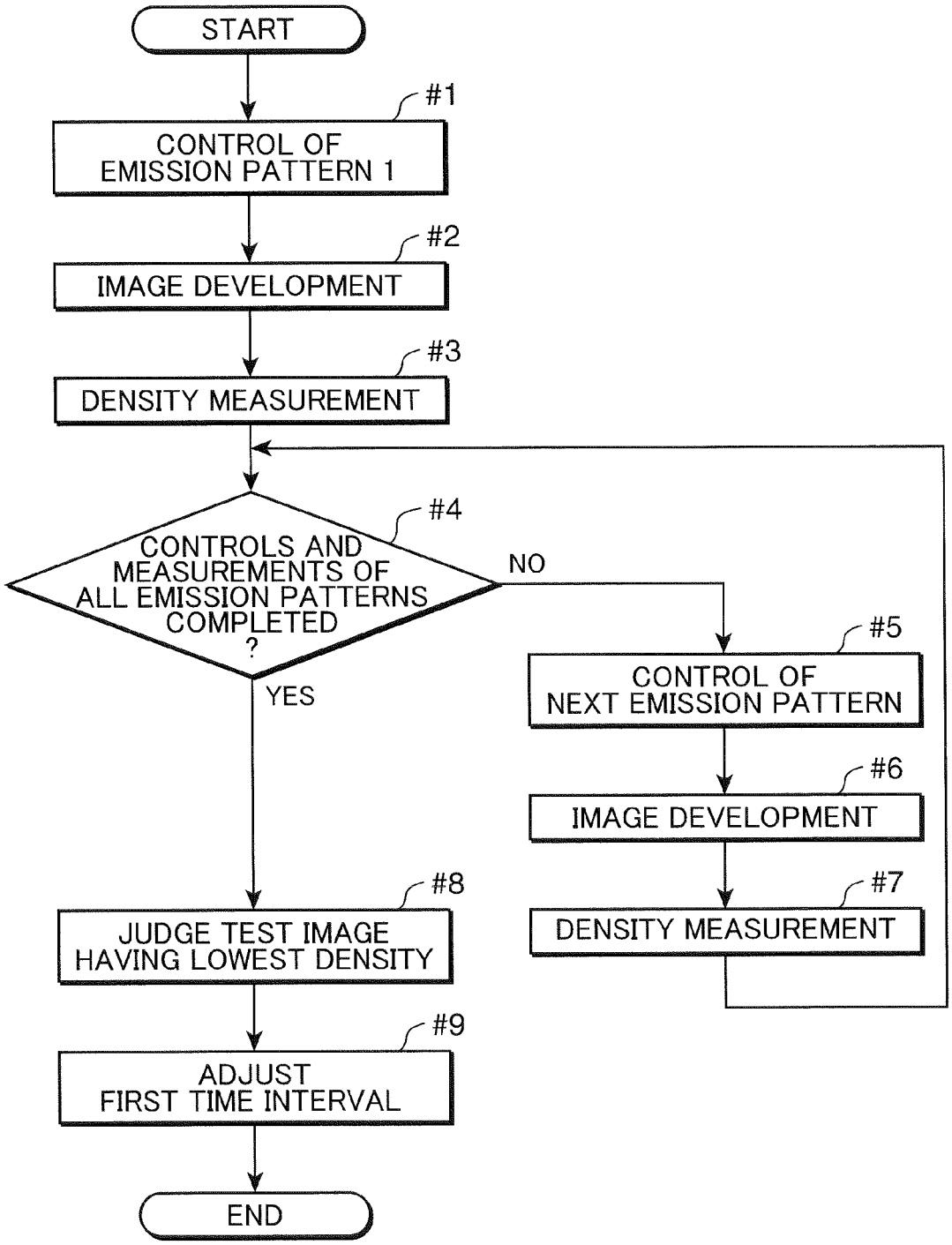
FIG. 16 is a flow chart showing a process in the calibration mode (first time interval adjustment mode) in the embodiment.

FIG. 16 is a flow chart showing a process in the calibration mode. The complex machine 1 executes the controls of the emission patterns 1 to 5 with the first time interval set at Δt, (Δt+Δα), (Δt+2Δα), (Δt−Δα) and (Δt−2Δα).

The light emission controlling section 104 executes the control of the emission pattern 1 (Step #1). The instructing section 105 instructs the developing unit 17 to develop an electrostatic latent image 51 of a test image formed on the surface 15A of the photoconductive drum 14 by the control of the emission pattern 1 (Step #2). The instructing section 105 instructs the density measuring section 108 to measure the density of the developed test image (Step #3).

Subsequently, the control unit 100 judges whether or not the controls and density measurements of all the emission patterns have been completed (Step #4). Unless it is judged that the controls and density measurements of all the emission patterns have been completed (NO in Step #4), the emission pattern is changed to the next one and the control of the changed emission pattern is executed (Step #5). Then, the instructing section 105 instructs the developing unit 17 to develop an electrostatic latent image 51 of a test image formed on the surface 15A of the photoconductive drum 14 by the control of this emission pattern (Step #6). After the density of the developed test image is measured by the density measuring section 108 (Step #7), this routine returns to Step #4.

In Step #4, if the control unit 100 judges that the controls and density measurements of all the emission patterns have been completed (YES in Step #4), the image write timing setting section 106 judges the test image having the lowest density out of the respective test images obtained by the controls of the respective emission patterns 1 to 5 (Step #8). The image write timing setting section 106 adjusts the first time interval used for the control in the image write controlling section 107 to the first time interval used to draw the electrostatic latent image 51 of the test image judged in Step #8 (Step #9). The adjusted first time interval is stored in the time interval data storage 102B and used for the control in the image write controlling section 107.

As described above, according to this embodiment, the test image having the lowest density is judged out of a plurality of test images formed by the controls of the light emission controlling section (second light emission controlling section) 104. Then, the first time interval used for the control in the image write controlling section (first light emission controlling section) 107 is adjusted to the first time interval used to draw the electrostatic latent image 51 of the above test image. Thus, even if the interval Δd between the beam spots shown in FIG. 5 changes due to a change in the environment of the complex machine 1 or the like, the image write starting positions of the respective laser beams LB1 to LB6 can be aligned in the main scanning direction D1.

Although there are six laser light sources LD in this embodiment, the adjustment of the first time interval in the present invention is not limited to the case where there are six laser light sources LD. The present invention is suitable when there are three or more laser light sources LD.

In this embodiment, the densities of the test images formed on the surface 15A of the photoconductive drum 15 are measured. In an image forming apparatus using a transfer belt, the densities of test images transferred from a photoconductive drum 15 to a transfer belt may be measured.

In place of or in addition to the above embodiment, the present invention may be embodied as follows.

(1) In the above embodiment, the first time interval used to draw the electrostatic latent image 51 of the test image having the lowest density is directly set as the first time interval used for the control in the image write controlling section 107. However, an interpolation processing may be performed to more accurately align the image write starting positions of the respective laser beams LB1 to LB6 in the main scanning direction D1 (bring them into coincidence).

The interpolation processing in this embodiment is described using a spline curve as an example of an approximation curve.

Figure 17:
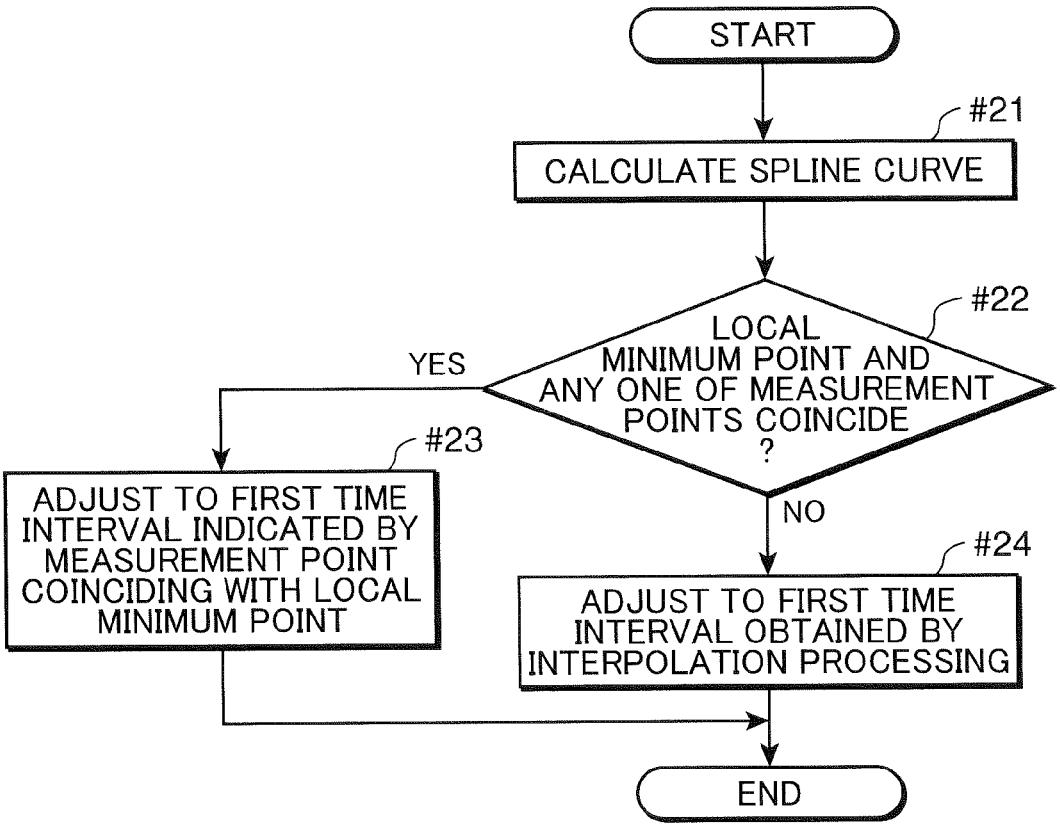
FIG. 17 is a flow chart showing a mode for calculating a first time interval using an interpolation processing in the embodiment.
Figure 18:
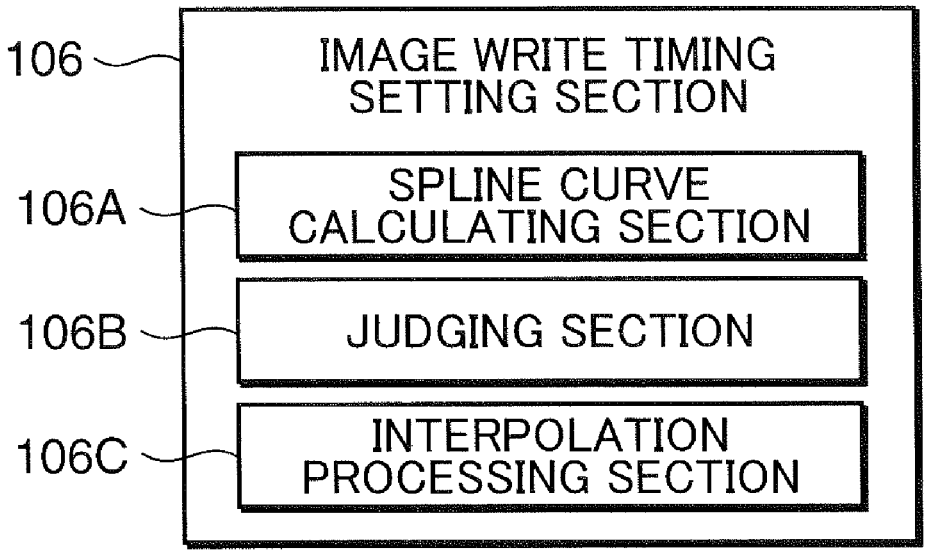
FIG. 18 is a functional block diagram of an image write timing setting section (first time interval adjusting section) used in the above mode.
Figure 19:
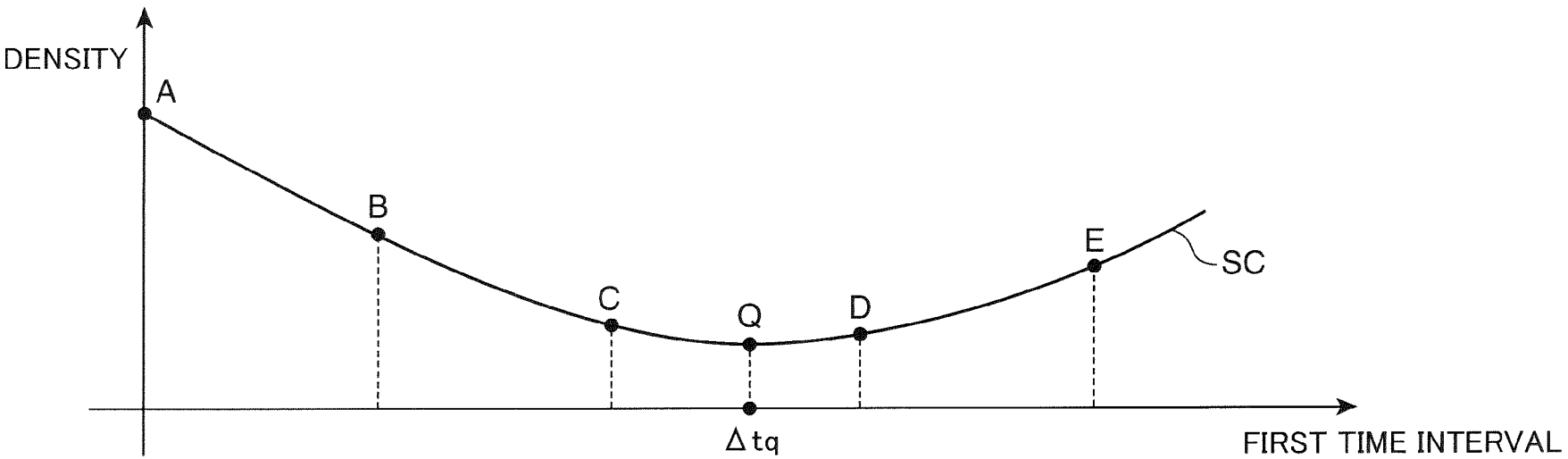
FIG. 19 is a graph showing an example of a spline curve used in the above mode.

FIG. 17 is a flow chart showing this interpolation processing. FIG. 18 is a functional block diagram of the image write timing setting section (first time interval adjusting section) 106 for performing this interpolation processing. The image write timing setting section 106 includes a spline curve calculating section 106A, a judging section 106B and an interpolation processing section 106C. FIG. 19 is a graph plotting the density measurement results of the test images obtained by the controls of the respective emission patterns as measurement points A to E with a horizontal axis representing the first time interval and a vertical axis representing the density of the test images obtained in the controls of the respective emission patterns.

The spline curve calculating section 106A sets a coordinate system as shown in FIG. 19 and plots the measurement results relating to the densities of the test images when the densities of the respective test images are measured by the density measuring section 108. Then, the spline curve calculating section 106A calculates a spline curve SC passing through the respective measurement points A to E (Step #21). The judging section 106B judges whether or not a local minimum point of the spline curve SC coincides with any one of the measurement points A to E (Step #22).

If the local minimum point of the spline curve SC is judged by the judging section 106B to coincide with any one of the measurement points A to E (YES in Step #22), the image write timing setting section 106 adjusts the first time interval used for the control in the image write controlling section 107 to the first time interval indicated by the measurement point coinciding with the local minimum point (Step #23).

On the other hand, if the local minimum point of the spline curve SC is judged by the judging section 106B to coincide with none of the measurement points A to E (NO in Step #22), the interpolation processing section 106C performs the interpolation processing to calculate the first time interval. The interpolation processing section 106C calculates a first time interval Δtq using a plurality of measurement points located near the local minimum point. The image write timing setting section 106 adjusts the first time interval used for the control in the image write controlling section 107 to the first time interval Δtq calculated by the interpolation processing (Step #24).

For example, if the local minimum point Q of the spline curve SC is located between the measurement points C and D as shown in FIG. 19, the interpolation processing section 106C calculates the first time interval Δtq indicated by the local minimum point Q according to a relationship of a first state of change and a second state of change, a first ratio and the like. Here, the first state of change is a state of change of the spline curve SC to the left of the local minimum point Q determined based on the measurement points A, B, C and D. The second state of change is a state of change of the spline curve SC to the right of the local minimum point Q determined based on the measurement points C, D and E. The first ratio is a ratio of a distance from the local minimum point Q to the measurement point C and a distance from the local minimum point Q to the measurement point D.

For example, it is assumed that the density indicated by the measurement point C is lowest among the respective measurement points A to E. In the case of not having the interpolation processing function, the first time interval used for the control in the image write controlling section 107 is adjusted to the first time interval corresponding to the measurement point C and including an error. By having the interpolation processing function, the image write starting positions of the respective light beams LB1 to LB6 can be more accurately aligned in the main scanning direction D1.

(2) The test image having the lowest density out of a plurality of test images may be judged by a service person or a user (hereinafter, an "operator"). The complex machine 1 according to this embodiment includes the transfer unit 18 for outputting sheets bearing test images obtained by the controls of the respective emission patterns and an input operation unit (operation unit 23) for receiving an input designating the test image recognized by the operator to have the lowest density as a result of comparison of the densities of the test images formed on the respective sheets. The image write timing setting section 106 adjusts the first time interval used for the control in the image write controlling section 107 based on the first time interval used to draw an electrostatic latent image 51 of the test image designated by the input operation unit. In this embodiment, it is not necessary to provide the density measuring section 108.

Figure 20:
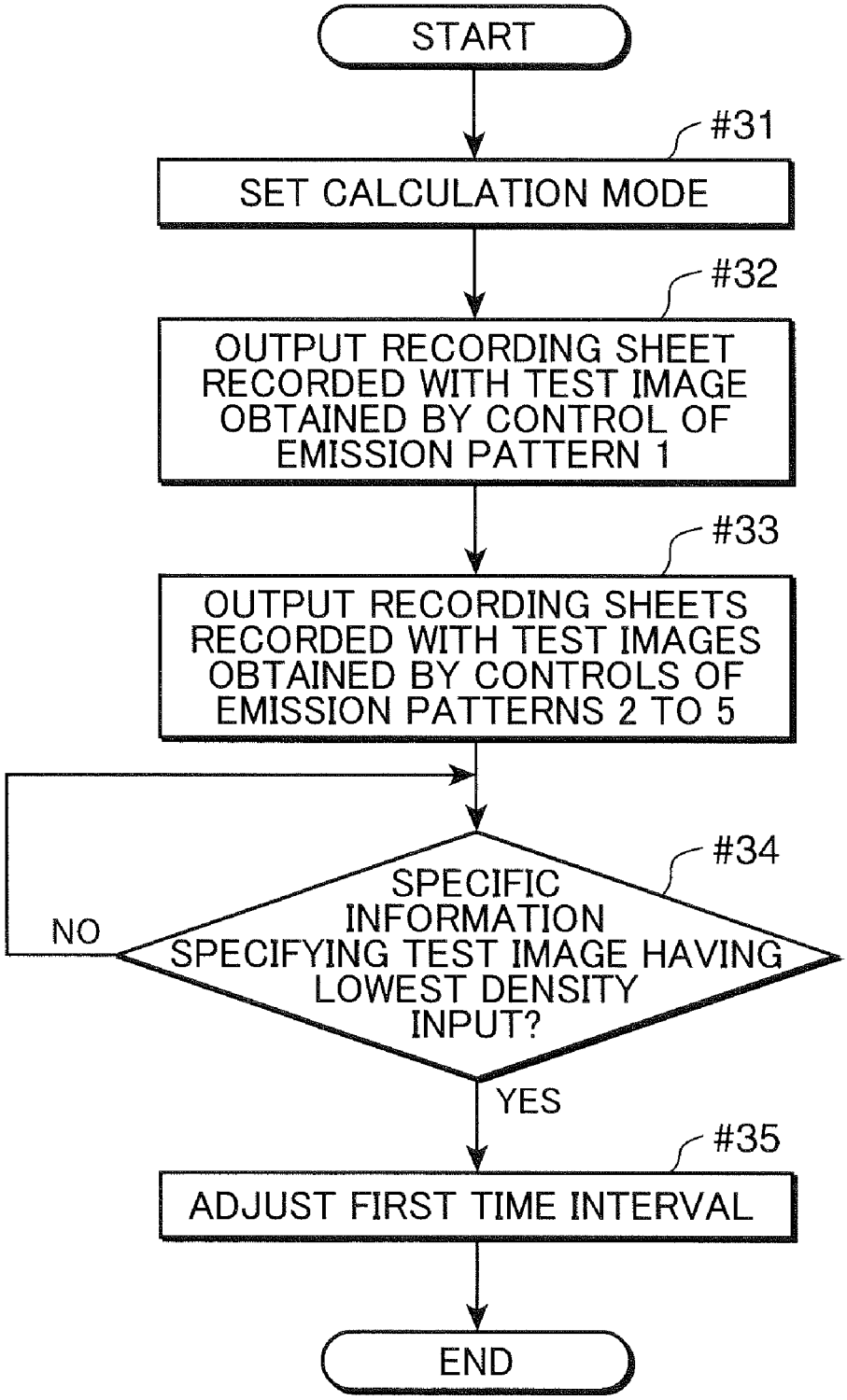
FIG. 20 is a flow chart showing a mode in which an operator determines a test image having the lowest density in the embodiment.

The embodiment (2) is described with reference to a flow chart shown in FIG. 20. The operator operates the operation unit 23 of FIG. 1 to cause the mode setting section 101 of FIG. 3 to set the calibration mode (Step #31).

The light emission controlling section (second light emission controlling section) 104 executes the control of the emission pattern 1 of FIG. 10. Thus, an electrostatic latent image 51 of a test image obtained by the control of the emission pattern 1 is formed on the photoconductive drum 15. The test image formed on the photoconductive drum 15 is developed by the developing unit 17 of FIG. 1. The developed test image is transferred to a recording sheet by the transfer unit 18 of FIG. 1. The test image transferred to the recording sheet is fixed to the recording sheet by the fixing unit 19 of FIG. 1 and output (Step #32). The transfer and fixing processes are carried out by the image output unit 14*a* of FIG. 2.

Test images obtained by the controls of the emission patterns 2 to 5 are similarly recorded on recording sheets and output (Step #33).

A total of five recording sheets are output from the image output unit 14A of FIG. 2. Specifically, the recording sheet recorded with the test image obtained by the control of the emission pattern 1, the recording sheet recorded with the test image obtained by the control of the emission pattern 2, the recording sheet recorded with the test image obtained by the control of the emission pattern 3, the recording sheet recorded with the test image obtained by the control of the emission pattern 4 and the recording sheet recorded with the test image obtained by the control of the emission pattern 5 are output.

For example, it is assumed that the electrostatic latent image 51 of the test image obtained by the control of the emission pattern 1 is the electrostatic latent image 51 of FIG. 14C. Electrostatic latent images 51 of the test images obtained by the emission patterns 2, 3, 4 and 5 are those of FIGS. 14D, 14E, 14B and 14A.

Specific information specifying the test images is recorded on the five recording sheets. For example, a number "1" is recorded on the sheet recorded with the test image of the emission pattern 1, a number "2" is recorded on the sheet recorded with the test image of the emission pattern 2, a number "3" is recorded on the sheet recorded with the test image of the emission pattern 3, a number "4" is recorded on the sheet recorded with the test image of the emission pattern 4 and a number "5" is recorded on the sheet recorded with the test image of the emission pattern 5. These test images may be recorded on one recording sheet.

The operator judges the test image having the lowest density and inputs the number (specific information) specifying this test image using the numerical pad 25 of the operation unit 23 of FIG. 1.

In the case of the above input (YES in Step #34), the image write timing setting section 106 adjusts the time interval used for the control in the image write controlling section 107 to the first time interval used to draw the electrostatic latent image 51 of the test image specified by the input specific information (Step #35). The adjusted first time interval is stored in the time interval data storage 102B of FIG. 3 and used for the control in the image write controlling section 107.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a light source unit including a plurality of light sources for irradiating a multibeam composed of light beams emitted from the plurality of light sources;

a light beam deflector for deflecting the multi-beam irradiated from the light source unit in a main scanning direction;

an image carrier, on which an electrostatic latent image is to be drawn by the multi-beam deflected by the light beam deflector; and a timing signal generator for generating timing signals on a basis for the starts of image writing operations at the starts of the image writing operations by the plurality of light sources to start drawing an electrostatic latent image on the image carrier, the timing signal generator including a first optical sensor for receiving the light beams respectively emitted from the plurality of light sources to obtain timing signals after the light beams are deflected by the light beam deflector, the timing signal generator for generating the timing signals based on signals output from the first optical sensor;

wherein:

a positional relationship of the plurality of light sources with respect to the first optical sensor is so set that the timing signals corresponding to the light beams respectively emitted from the plurality of light sources can be separately generated at different timings by the timing signal generator; and the image forming apparatus further comprises:

a first light emission controlling section used in a normal operation mode for executing a control to shift the starts of the image writing operations by the plurality of light sources by a first time interval to align image write starting positions of the respective light beams in the main scanning direction in the case of drawing an electrostatic latent image on the image carrier by the multi-beam irradiated from the light source unit on a basis the timing signals generated by the timing signal generator;

a time interval data storage storing the first time interval used for the control in the first light emission controlling section beforehand;

a test image data storage storing an image data of a test image beforehand, in which dot rows each formed by one-dot images arranged in a row in a sub scanning direction are arranged at predetermined intervals in the main scanning direction;

an operation controlling section for controlling the operation of the image carrier at such a speed that the dot images adjacent in the sub scanning direction overlap;

a second light emission controlling section used in a first time interval adjustment mode for drawing an electrostatic latent image of the test image on the image carrier by causing the light source unit to irradiate a multi-beam modulated by the test image data stored in the test image data storage on a basis the timing signals generated by the timing signal generator and causing the light beam deflector to deflect the multibeam with the image carrier moved by the operation controlling section, and the second light emission controlling section for executing a control to draw electrostatic latent images of a plurality of test images with different first time intervals;

a developing unit for developing the electrostatic latent images of the test images drawn on the image carrier by the second light emission controlling section;

a density measuring section for measuring the densities of the plurality of test images developed by the developing unit; and a first time interval adjusting section for storing the first time interval used to draw the electrostatic latent image of the test image having the lowest density out of the plurality of test images measured by the density measuring section in the time interval data storage as the first time interval used for the control in the first light emission controlling section, wherein:

the first light emission controlling section executes the control to shift the starts of the image writing operations by the plurality of light sources by the first time interval to align image write starting positions of the respective light beams in the main scanning direction in the normal operation mode, using the first time interval stored in the time interval data storage by the first time interval adjusting section.

2. An image forming apparatus according to claim 1, wherein the electrostatic latent images of the test images are drawn with such an amount of light at which the density of overlapping dot images and that of the non-overlapping dot images are equal in the control in the second light emission controlling section.

3. An image forming apparatus according to claim 1, wherein the operation controlling section controls the image carrier to operate at such a speed that the next main scanning is performed before a surface of the image carrier where the electrostatic latent image is to be drawn moves in the sub scanning direction by the width of one main scanning line.

4. An image forming apparatus according to claim 1, wherein:

the first time interval adjusting section comprises:

an approximation curve calculating section for calculating an approximation curve based on the first time intervals used to draw the electrostatic latent images of the plurality of test images and measurement points as density measurement results of the plurality of test images, a judging section for judging whether or not there is any measurement point that coincides with a local minimum point of the approximation curve calculated by the approximation curve calculating section, and an interpolating processing section for calculating a first time interval indicated by the local minimum point by an interpolating processing using a plurality of measurement points located near the local minimum point if it is judged by the judging section that no measurement point coincides with the local minimum point, wherein:

the first time interval adjusting section stores the first time interval calculated in the interpolating processing section in the time interval data storage as the first time interval used for the control in the first light emission controlling section.

5. An image forming apparatus according to claim 4, wherein the approximation curve is a spline curve.

6. An image forming apparatus according to claim 1, wherein the image carrier is rotated in the first time interval adjustment mode at a specified rotating speed slower than a rotating speed in the normal operation mode.

7. An image forming apparatus according to claim 1, wherein:

the plurality of light sources are arranged in a row, and the row of the plurality of light sources is inclined with respect to the main scanning direction and the sub scanning direction.

8. An image forming apparatus according to claim 7, wherein the plurality of light sources are formed on the same semiconductor substrate.

9. An image forming apparatus according to claim 1, wherein the plurality of light sources are unitized and rotatable about a normal to tip surface thereof.

10. An image forming apparatus, comprising:

a light source unit including a plurality of light sources for irradiating a multibeam composed of light beams emitted from the plurality of light sources;

a light beam deflector for deflecting the multi-beam irradiated from the light source unit in a main scanning direction;

an image carrier, on which an electrostatic latent image is to be drawn by the multi-beam deflected by the light beam deflector; and a timing signal generator for generating timing signals on a basis for the starts of image writing operations at the starts of the image writing operations by the plurality of light sources to start drawing an electrostatic latent image on the image carrier, the timing signal generator including a first optical sensor for receiving the light beams respectively emitted from the plurality of light sources to obtain timing signals after the light beams are deflected by the light beam deflector, the timing signal generator for generating the timing signals based on signals output from the first optical sensor;

wherein:

a positional relationship of the plurality of light sources with respect to the first optical sensor is so set that the timing signals corresponding to the light beams respectively emitted from the plurality of light sources can be separately generated at different timings by the timing signal generator; and the image forming apparatus further comprises:

a first light emission controlling section used in a normal operation mode for executing a control to shift the starts of the image writing operations by the plurality of light sources by a first time interval to align image write starting positions of the respective light beams in the main scanning direction in the case of drawing an electrostatic latent image on the image carrier by the multi-beam irradiated from the light source unit on a basis the timing signals generated by the timing signal generator;

a time interval data storage storing the first time interval used for the control in the first light emission controlling section beforehand;

a test image data storage storing an image data of a test image beforehand, in which dot rows each drawn by one-dot images arranged in a row in a sub scanning direction are arranged at predetermined intervals in the main scanning direction;

an operation controlling section for controlling the operation of the image carrier at such a speed that the dot images adjacent in the sub scanning direction overlap;

a second light emission controlling section used in a first time interval adjustment mode for drawing an electrostatic latent image of a test image on the image carrier by causing the light source unit to irradiate a multi-beam modulated by the test image data stored in the test image data storage on a basis the timing signals generated by the timing signal generator and causing the light beam deflector to deflect the multibeam with the image carrier moved by the operation controlling section, and the second light emission controlling section for executing a control to draw electrostatic latent images of a plurality of test images with different first time intervals;

a developing unit for developing the electrostatic latent images of the test images drawn on the image carrier by the second light emission controlling section;

an image output unit for outputting the plurality of test images developed by the developing unit by recording them on a recording sheet or recording sheets;

an operation unit for receiving an operation of inputting specific information specifying the test image having the lowest density out of the plurality of test images output by the image output unit; and a first time interval adjusting section for storing the first time interval used to draw the electrostatic latent image of the test image specified by the specific information input to the operation unit in the time interval data storage as the first time interval used for the control in the first light emission controlling section, wherein:

the first light emission controlling section executes the control to shift the starts of the image writing operations by the plurality of light sources by the first time interval to align image write starting positions of the respective light beams in the main scanning direction in the normal operation mode, using the first time interval stored in the time interval data storage by the first time interval adjusting section.

11. An image forming apparatus according to claim 10, wherein the electrostatic latent images of the test images are drawn with such an amount of light at which the density of overlapping dot images and that of the non-overlapping dot images are equal in the control in the second light emission controlling section.

12. An image forming apparatus according to claim 10, wherein the operation controlling section controls the image carrier to operate at such a speed that the next main scanning is performed before a surface of the image carrier where the electrostatic latent image is to be drawn moves in the sub scanning direction moves by the width of one main scanning line.

13. An image forming apparatus according to claim 10, wherein:

the plurality of light sources are arranged in a row, and the row of the plurality of light sources is inclined with respect to the main scanning direction and the sub scanning direction.

14. An image forming apparatus according to claim 13, wherein the plurality of light sources are formed on the same semiconductor substrate.

* * * * *